US005795706A

United States Patent [19]

Ihama

[11] Patent Number: 5,795,706

[45] Date of Patent: Aug. 18, 1998

[54] SILVER HALIDE COLOR PHOTOGRAPHIC LIGHT-SENSITIVE MATERIAL

[75] Inventor: Mikio Ihama, Kanagawa, Japan

[73] Assignee: Fuji Photo Film Co., Ltd., Kanagawa, Japan

[21] Appl. No.: 613,672

[22] Filed: Mar. 11, 1996

[30] Foreign Application Priority Data

Mar. 17, 1995 [JP] Japan ..... 7-086413

[51] Int. Cl.[6] ..... G03C 1/46

[52] U.S. Cl. ..... 430/506; 430/502; 430/503; 430/504; 430/567

[58] Field of Search ..... 430/502, 503, 430/504, 506, 567

[56] References Cited

U.S. PATENT DOCUMENTS

| | | | |
|---|---|---|---|
| 4,970,140 | 11/1990 | Heki et al. | 430/506 |
| 5,283,164 | 2/1994 | Fenton et al. | 430/506 |
| 5,302,499 | 4/1994 | Merrill et al. | 430/506 |
| 5,466,566 | 11/1995 | Tashiro et al. | 430/506 |

OTHER PUBLICATIONS

J. Gasper et al., Optical Properties of the Photographic Emulsion, Chap. 20, pp. 578–591, Macmillan, New York (1977).

*Primary Examiner*—Geraldine Letscher
*Attorney, Agent, or Firm*—Birch, Stewart, Kolasch & Birch, LLP

[57] ABSTRACT

A silver halide color photographic light-sensitive material is described, which comprises a support having provided thereon at least one blue-sensitive silver halide emulsion layer, at least one green-sensitive silver halide emulsion layer and at least one red-sensitive silver halide emulsion layer, wherein at least one of said blue-, green- and red-sensitive silver halide emulsion layers comprises a low-, medium- and high-sensitivity silver halide emulsion layers provided in this order from the side near to the support, the average grain thickness of all silver halide grains in the low-sensitivity silver halide emulsion layer is from 0.15 to less than 0.25 μm, the average grain thickness of all silver halide grains in the medium-sensitivity silver halide emulsion layer is from 0.15 to less than 0.25 μm and the average grain thickness of all silver halide grains in the high-sensitivity silver halide emulsion layer is from 0.15 to less than 0.25 μm.

11 Claims, 3 Drawing Sheets

SILVER HALIDE COLOR PHOTOGRAPHIC LIGHT-SENSITIVE MATERIAL

FIELD OF THE INVENTION

The present invention relates to a silver halide color photographic light-sensitive material, more specifically, to a silver halide color photographic light-sensitive material used as a color photographic film improved in sharpness and having a format different from the conventional film.

BACKGROUND OF THE INVENTION

With silver halide color photographic light-sensitive material, particularly with silver halide color photographic light-sensitive material for photographing, an important problem is improving sharpness while keeping the sensitivity. In order to improve sharpness, it is necessary to improve both an MTF value (modulation transfer function value) on the high frequency side having a relation to the delicate description of an original image and an MTF value on the low frequency side having a relation to the rude description thereof. However, these two values can be little improved at the same time. This is described in detail in T. H. James, *The Theory of the Photographic Process*, Chap. 20, pp. 578–591, Macmillan, N.Y. (1977).

On the other hand, recently, as photography frequency increases, improvements in portability and handiness contingent to the down-sizing of a camera are requested and the silver halide color photographic light-sensitive material is concomitantly needed to have a small format. As a result, the enlargement on a print needs to be made at a higher magnification and accordingly, the improvement of sharpness is a matter of more and more importance.

When a tabular grain is used as the silver halide emulsion grain, it is particularly difficult to improve the MTF value on the high frequency side and the MTF value on the low frequency side at the same time. U.S. Pat. No. 5,302,499 discloses a method of achieving improvement in the relation between sensitivity and sharpness (namely, to improve sharpness while keeping high sensitivity) by setting the aspect ratio of a silver halide grain and the grain thickness in each of layers different in spectral sensitivity to specific values. However, according to this method, the grain thickness for improving the relation between sensitivity and sharpness differs among cases of blue light, green light and red light, and improvement in the relation between sensitivity and sharpness for blue light, green light and red right cannot be obtained at the same time.

SUMMARY OF THE INVENTION

The object of the present invention is to improve the relationships between sensitivity and sharpness. In particular, the object of the present invention is to provide a silver halide color photographic light-sensitive material effective for use when the picture area of the film for photographing is reduced and enlargement at a higher magnification is obliged, thereby causing extreme deterioration in sharpness of a print.

The object of the present invention can be achieved by the inventions described below.

(1) A silver halide color photographic light-sensitive material comprising a support having provided thereon at least one blue-sensitive silver halide emulsion layer, at least one green-sensitive silver halide emulsion layer and at least one red-sensitive silver halide emulsion layer, wherein at least one of the blue-sensitive silver halide emulsion layer, the green-sensitive silver halide emulsion layer and the red-sensitive silver halide emulsion layer comprises a low-sensitivity silver halide emulsion layer, a medium-sensitivity silver halide emulsion layer and a high-sensitivity silver halide emulsion layer having substantially the same spectral sensitivity but different in sensitivity, the low-sensitivity silver halide emulsion layer, the medium-sensitivity silver halide emulsion layer and the high-sensitivity silver halide emulsion layer are provided in this order from the side near to the support, the average grain thicknesses of all silver halide grains in the low-sensitivity silver halide emulsion layer is from 0.15 to less than 0.25 μm, the average grain thickness of all silver halide grains in the medium-sensitivity silver halide emulsion layer is from 0.15 to less than 0.25 μm and the average grain thickness of all silver halide grains in the high-sensitivity silver halide emulsion layer is from 0.15 to less than 0.25 μm.

As also clearly verified in the Examples set forth later, when at least one of blue-sensitive, green-sensitive and red-sensitive layers comprises low-sensitivity, medium-sensitivity and high-sensitivity silver halide emulsion layers provided in this order from the side near to the support and the average grain thickness of all silver halide grains in three layers different in sensitivity falls within a prescribed range, the relation between sensitivity and sharpness is improved. In view of improvement in effects and practical usefulness, the following embodiments are particularly preferred.

(2) A silver halide color photographic light-sensitive material as described in (1) above, wherein the green-sensitive silver halide emulsion layer or the red-sensitive silver halide emulsion layer comprises the low-sensitivity, medium-sensitivity and high-sensitivity silver halide emulsion layers.

(3) A silver halide color photographic light-sensitive material as described in (1), wherein the green-sensitive silver halide emulsion layer and the red-sensitive silver halide emulsion layer each comprises the low-sensitivity, medium-sensitivity and high-sensitivity silver halide emulsion layers.

(4) A silver halide color photographic light-sensitive material as described in (2), wherein the low-sensitivity, medium-sensitivity and high-sensitivity silver halide emulsion layers are provided continuously to be in contact with each other.

(5) A silver halide color photographic light-sensitive material as described in (1), wherein the support comprises a belt-like polyester base, from 1 to 4 perforations are formed per one picture on one or both side edge part of the support, the image part area is from 3.0 to 7.0 $cm^2$ and the aspect ratio thereof is from 1.40 to 2.50.

DESCRIPTION OF SYMBOLS

Figure 1:
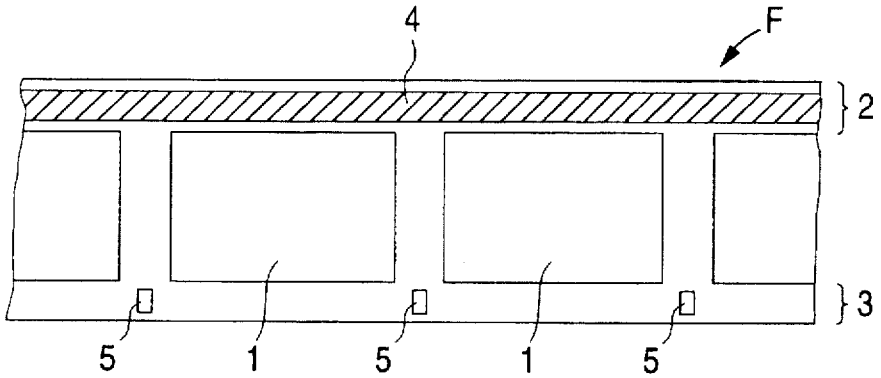
FIG. 1 is a plan view showing a part of the constitution according to one embodiment of a film prepared using the light-sensitive material of the present invention, where one square perforation was formed on one side edge part of the film per one picture.

F: film, 1: exposure part picture, 2,3: frame part, 4: magnetic track, 5: perforation, 6: support, 7: magnetic substance, 8: hydrophilic colloid layer, 9: undercoat layer.

DETAILED DESCRIPTION OF THE INVENTION

The present invention is described below in detail.

The silver halide color photographic light-sensitive material of the present invention comprises a support having provided thereon at least one unit blue-sensitive silver halide emulsion layer, at least one unit green-sensitive silver halide emulsion layer and at least one unit red-sensitive silver halide emulsion layer. The unit light-sensitive layers are generally arranged such that the red-sensitive layer, the green-sensitive layer and the blue-sensitive layer are provided in this order from the support side. However, depending upon the purpose, any order may be arranged. Further, each silver halide light-sensitive layer may comprise a light-insensitive layer as an uppermost layer or a lowermost layer or may contain couplers, DIR compounds or color mixing inhibitors which will be described later.

In the present invention, at least one unit silver halide emulsion layer comprises a low-sensitivity silver halide emulsion layer, a medium-sensitivity silver halide emulsion layer, a high-sensitivity silver halide emulsion layer provided in this order from the side near to the support. This constitution contributes to the improvement of sharpness (see Examples). This is assumed because a high-sensitivity silver halide emulsion layer having a largest silver coated amount shows the highest light absorption and a medium-sensitivity silver halide emulsion layer follows it, as a result, the absolute quantity of light scattered to reach the lower layer is reduced.

The unit light-sensitive layer having coated therein these three layers may be any of the blue-sensitive layer, the green-sensitive layer and the red-sensitive layer, or all unit light-sensitive layers may comprise the three layers. The term "the low-sensitivity silver halide emulsion layer, the medium-sensitive silver halide emulsion layer and the high-sensitivity silver halide emulsion layer" as used herein means that the sensitivity of respective layers elevates in this order when subjected to coating, exposure and development under the same conditions, and preferably, the sensitivity relation among them is such that respective layers are differentiated by ½ stop or more. These low-, medium- and high-sensitivity emulsion layers are preferably coated continuously to come into contact with each other, in other words, no interlayer such as light-insensitive layer is provided thereamong.

Due to the same reason as described above, it is preferred that at least green-sensitive silver halide emulsion layer and/or red-sensitive silver halide emulsion layer satisfy the above-described relation.

Further, in the present invention, it is essential that the low-, medium- and high-sensitivity silver halide emulsion layers each comprises silver halide grains having an average grain thickness in a prescribed range, however, as a preamble of the description thereon, the grain thickness is described. The silver halide grain in the photographic emulsion is roughly classified into grains having a regular form such as cubic, octahedral or tetradecahedral and grains having an irregular form such as tabular. In case of a grain having a regular form, the sphere-corresponding diameter of the grain is defined as the grain thickness and in case of a tabular grain having an irregular form, the distance between main planes is defined as the grain thickness. In either of a grain having a regular form or a tabular grain, the grain thickness can be determined by an electron microphotograph shadowed together with a latex for reference according to a carbon replica method. The average grain thickness is obtained as a number average of individual thicknesses of grains. The coefficient of variation of the grain thickness distribution is preferably 20% or less, more preferably 15% or less. In the present invention, the tabular grain is preferred more than the grain having a regular form. The tabular grain is usually in the form of hexagon, triangle or circle when viewed from the upside and the aspect ratio is the value obtained by dividing the diameter of a circle corresponding to the projected area by the thickness. The average aspect ratio is obtained as a number average of individual aspect ratios of grains. The tabular grains are preferably hexagonal in a higher proportion. The length ratio of sides adjacent to each other of the hexagon is preferably 1:2.

In the present invention, it is essential that the average grain thickness of all silver halide grains in the low-sensitivity silver halide emulsion layer of the three-layered unit light-sensitive layer is from 0.15 to less than 0.25 μm, however, a tabular silver halide grain having an average grain thickness of from 0.15 to less than 0.20 μm and an aspect ratio of from 1 to less than 4 is preferred.

It is essential that the average grain thickness of all silver halide grains in the medium-sensitivity silver halide emulsion layer of the three-layered unit light-sensitive layer is from 0.15 to less than 0.25 μm, however, a tabular silver halide grain having an average grain thickness of from 0.15 to less than 0.20 μm and an average aspect ratio of from 3 to less than 10 is preferred.

It is essential that the average grain thickness of all silver halide grains in the high-sensitivity silver halide emulsion layer of the three layered unit light-sensitive layer is from 0.15 to less than 0.25 μm, however, a tabular silver halide grain having an average grain thickness of from 0.15 to less than 0.20 μm and an average aspect ratio of from 5 to less than 15 is preferred.

As described above, in the present invention, it is essential that silver halide grains in the low-, medium- and high-sensitivity silver halide emulsion layers have a prescribed average grain thickness, and this essential factor also contributes to the improvement in sharpness (see Examples). This effect is considered to result from equalization in the effect of scattering due to the difference in grain thickness, among three layers.

In the present invention, the average grain thickness of all silver halide grains in each emulsion layer of the three-layered unit light-sensitive layer is preferably from 0.15 to less than 0.25 μm, more preferably from 0.15 to less than 0.20 μm.

The silver halide emulsion grain in each of the low-sensitivity, medium-sensitivity and high-sensitivity silver halide emulsion layers may be freely selected from silver halides but preferably comprises silver iodobromide or silver bromide. Silver chloride may be used but its content is preferably 3 mol % or less. The silver iodide content is preferably from 3 to 20 mol % and the coefficient of variation of the silver iodide content distribution among grains is preferably 20% or less. The silver iodide distribution inside a grain preferably has a structure and, in this case, the grain structure for the silver iodide distribution may be double, triple, quadruple or greater structure. The boundary in the silver iodide content among the structures may be clear or continuously and gently varied. The coefficient of variation of the grain size distribution of silver halide emulsion grains in the low-, medium- and high-sensitivity silver halide emulsion layers is preferably 20% or less, more preferably 15% or less.

In the present invention, as long as the above-described essential factors are satisfied, the tabular grain emulsion such as silver iodobromide or silver bromide may be prepared by various methods. The preparation of a tabular grain emulsion usually consists of fundamental three steps of nucleation, ripening and growth. In the nucleation step, the use of gelatin having a small methionine content described in U.S. Pat. Nos. 4,713,320 and 4,942,120, the nucleation at a high pBr described in U.S. Pat. No. 4,914,014 or the nucleation in a short time described in JP-A-2-222940 (the term "JP-A" as used herein means an "unexamined published Japanese patent application") is very effective in producing an emulsion comprising tabular grains as a constituent factor of the present invention. In the ripening step, the ripening in the presence of a base at a low concentration described in U.S. Pat. No. 5,254,453 or the ripening at a high pH described in U.S. Pat. No. 5,013,641 is effective in ripening the above-described tabular grain emulsion as the case may be. In the growth step, the growth at a low temperature described in U.S. Pat. No. 5,248,587 or the use of silver iodide fine grains described in U.S. Pat. Nos. 4,672,027 and 4,693,964 is particularly useful in growing the above-described tabular grain emulsion.

In the present invention, when the silver halide emulsion grain is a tabular grain, the grain preferably has dislocation lines (the dislocation line means a linear lattice defect present on the slip plane of a crystal at the boundary between the slipped region and the non-slipped region). The tabular grain having integrated therein dislocation lines has excellent photographic properties such as sensitivity and reciprocity law failure as compared with the tabular grain having no dislocation line and it is known that superior sharpness and graininess are achieved by using the grain in the light-sensitive material.

The dislocation lines on the tabular grain can be observed by a direct method using a transmission type electron microscope at low temperature described, for example, in J. F. Hamilton, *Phot. Sci. Eng.*, 11, 57 (1967) and T. Shiozawa, *J. Soc. Phot. Sci. Japan*, 35, 213 (1972). More specifically, a silver halide grain taken out from an emulsion carefully so as not to apply such a pressure as to cause generation of dislocation lines on the grain is placed on a mesh for observation by an electron microscope and observed according to a transmission method while laying the sample in a cool state so as to prevent any damage (e.g., print out) by the electron beams. The site and the number of dislocation lines on each grain can be determined by observing the grain from the direction perpendicular to the major plane on the photograph of the grain obtained as above.

The number of dislocation lines is 10 or more on average, more preferably 20 or more on average, per one grain. In the case when the dislocation lines are present crowdedly or intersected with each other on the observation, the number of dislocation lines per one grain cannot be accurately counted in some cases. However, even in these cases, an approximate number such as about 10, 20 or 30 lines can be counted and it is possible to discriminate the grain from those having only several dislocation lines. The average number of dislocation lines per one grain is obtained as a number average by counting the number of dislocation lines on 100 or more grains.

The dislocation lines can be integrated, for example, in the vicinity of outer circumference of a tabular grain. In this case, the dislocation is nearly perpendicular to the outer circumference and the dislocation lines generated extend from the position at x% length of the distance between the center of the tabular grain and the side (outer circumference) to the outer circumference. x is preferably from 10 to less than 100, more preferably from 30 to less than 99, most preferably from 50 to less than 98. In this case, the shape formed by connecting the starting points of dislocation lines is nearly a similar figure to the grain form but not completely a similar figure and may deform in some cases. This type of dislocation line is not observed in the center region of a grain. The dislocation lines crystallographically direct towards the (211) direction but frequently weave or sometimes intersect with each other.

The dislocation lines may be present nearly uniformly throughout the entire outer circumference of a tabular grain or may be present at a local site on the outer circumference. More specifically, for example, in the case of a hexagonal tabular silver halide grain, the dislocation lines may be limited only to the neighborhood of six peaks or may be limited only to the neighborhood of one peak among them. On the contrary, the dislocation lines may be limited only to sides exclusive of the neighborhood of six peaks.

Further, the dislocation lines may be formed over the region including the centers of two parallel major planes of a tabular grain. When the dislocation lines are formed over the entire surface of a major plane, they may be crystallographically directed nearly towards the (211) direction upon viewing from the direction perpendicular to the major plane but sometimes directed towards the (110) direction or formed randomly. Further, respective dislocation lines are random in the length and some dislocation may be observed as a short line on the major plane or some dislocation may be observed as a long line extending to the side (outer circumference). The dislocation lines may be linear or may be weaving in not a few frequency. The dislocation lines often intersect with each other.

The sites of the dislocation lines may be limited to on the outer circumference, on the major plane or at the local site as described above, or the dislocation lines may be formed on these sites together, that is, may be present on the outer circumference and on the major plane at the same time.

Gelatin is advantageous as a protective colloid used at the preparation of the emulsion for use in the present invention or as a binder in other hydrophilic colloid layers, however, a hydrophilic colloid other than gelatin may also be used.

Examples thereof include proteins such as gelatin derivatives, graft polymers of gelatin to other high polymer, albumin and casein; saccharide derivatives such as cellulose derivatives, e.g., hydroxyethyl cellulose, carboxymethyl cellulose and cellulose sulfate, sodium arginates and starch derivatives; and various synthetic hydrophilic high polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may be a lime-processed gelatin, an acid-processed gelatin or an enzyme-processed gelatin as described in *Bull. Soc. Photo. Japan*, No. 16, p. 30 (1966), and a hydrolysate or enzymolysate of gelatin may also be used.

The emulsion for use in the present invention is desalted by water washing and a new protective colloid dispersion is preferably prepared. The temperature for water washing may be selected depending upon the purpose, but it is preferably from 5° to 50° C. The pH at the time of water washing may be also selected depending upon the purpose, but it is preferably from 2 to 10, more preferably from 3 to 8. The pAg at the time of water washing may also be selected depending upon the purpose, but it is preferably from 5 to 10. The method of water washing may be selected from the noodle water washing method, the dialysis method using a semipermeable membrane, the centrifugal separation method, the coagulation precipitation method and the ion exchange method. The coagulation precipitation method may be selected from a method using sulfate, a method using an organic solvent, a method using a water-soluble method and a method using a gelatin derivative.

At the time of preparing the emulsion for use in the present invention, it is preferred depending on the purpose to let a metal ion salt be present, for example, during grain formation, at the desilvering step, at the time of chemical sensitization or before coating. The metal ion salt is preferably added at the grain formation when it is doped to a grain and between after grain formation and before the completion of chemical sensitization when it is used for modification of the grain surface or as a chemical sensitizer. The metal ion salt may be doped to the entire of a grain, only to the core part, only to the shell part or only to the epitaxial part of a grain, or only to the substrate grain. Examples of the metal include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals may be added if it is in the form of a salt capable of dissolution at the grain formation, such as an ammonium salt, an acetic acid salt, a nitric acid salt, a sulfuric acid salt, a phosphoric acid salt, a hydroxyl salt, a 6-coordinated complex salt or a 4-coordinated complex salt. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. The ligand of the coordination compound can be selected from halo, aquo, cyano, cyanate, thiocyanate, nitrosyl, thionitrosyl, oxo and carbonyl. These metal compounds may be used individually or in combination of two or more.

The metal compound is preferably added after dissolving it in water or an appropriate organic solvent such as methanol or acetone. In order to stabilize the solution, a method of adding an aqueous hydrogen halide solution (e.g., HCl, HBr) or an alkali halide (e.g., KCl, NaCl, KBr, NaBr) may be used. Also, if desired, an acid or an alkali may be added. The metal compound may be added to the reaction vessel either before grain formation or during grain formation. Further, the metal compound may be added to a water-soluble silver salt (e.g., $AgNO_3$) or an aqueous alkali halide solution (e.g., NaCl, KBr, KI) and then continuously added during the silver halide grain formation. Furthermore, a solution may be prepared independently from a water-soluble silver salt or an alkali halide and continuously added at an appropriate time during the grain formation. A combination of various addition methods is also preferred.

The addition of a chalcogenide compound during the preparation of an emulsion as described in U.S. Pat. No. 3,772,031 is also useful in some cases. Other than S, Se and Te, a cyanate, a thiocyanate, a selencyanate, a carbonate, a phosphate or an acetate may also be present.

The silver halide grain for use in the present invention may be subjected to sulfur sensitization, selenium sensitization, gold sensitization or palladium sensitization or at least one of noble metal sensitization and reduction sensitization at any step during the preparation of a silver halide emulsion. A combination of two or more sensitization methods is preferred. By selecting the step when the chemical sensitization is carried out, various types of emulsions may be prepared. The chemical sensitization specks are embedded, in one type, inside the grain, in another type, embedded in the shallow part from the grain surface, and in still another type, formed on the grain surface. In the emulsion of the present invention, the site of chemical sensitization specks may be selected according to the purpose, however, in general, it is preferred that a kind of chemical sensitization specks are formed in the vicinity of the surface.

One of the chemical sensitization which can be preferably used in the present invention is chalcogenide sensitization, noble metal sensitization or a combination of these sensitizations. The chemical sensitization may be carried out using an active gelatin as described in T. H. James, *The Theory of the Photographic Process*, 4th ed. Macmillan, pp. 67–76 (1977), or sulfur, selenium, tellurium, gold, platinum, palladium, iridium or a combination of these sensitizers in plurality may be used at a pAg of from 5 to 10, a pH of from 5 to 8 and a temperature of from 30° to 80° C. as described in *Research Disclosure*, Vol. 120, 12008 (April, 1974), *Research Disclosure*, Vol. 34, 13452 (June, 1975), U.S. Pat. Nos. 2,642,361, 3,297,446, 3,772,031, 3,857,711, 3,901,714, 4,266,018 and 3,904,415 and British Patent 1,315,755. In the noble metal sensitization, a noble metal salt such as gold, platinum, palladium or iridium may be used and in particular, gold sensitization, palladium sensitization and a combination use of these two sensitizations are preferred. In the case of gold sensitization, a known compound such as chloroaurate, potassium chloroaurate, potassium aurithiocyanate, gold sulfide or gold selenide may be used. The palladium compound means a palladium divalent salt or quatervalent salt. The preferred palladium compound is represented by $R_2PdX_6$ or $R_2PdX_4$, wherein R represents a hydrogen atom, an alkali metal atom or an ammonium group and X represents a halogen atom such as chlorine, bromine or iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and the palladium compound each is preferably used in combination of a thiocyanate or a selenocyanate.

As the sulfur sensitizer, a hypo, a thiourea-based compound, a rhodanine-based compound and in addition, a sulfur-containing compound described in U.S. Pat. Nos. 3,857,711, 4,266,018 and 4,054,457 may be used. The chemical sensitization may also be carried out in the presence of a so-called chemical sensitization aid. The useful chemical sensitization aid includes compounds known to suppress the fogging and at the same time, increase the sensitivity during the chemical sensitization, such as azaindene, azapyridazine and azapyrimidine. Examples of the chemical sensitization aid modifier are described in U.S. Pat. Nos. 2,131,038, 3,411,914 and 3,554,757, JP-A-58-126526 and Duffin, *Photographic Emulsion Chemistry* (cited above), pp. 138–143.

To the emulsion for use in the present invention, gold sensitization is preferably applied in combination. The amount of the gold sensitizer is preferably from $1\times10^{-7}$ to $1\times10^{-4}$ mol, more preferably from $5\times10^{-7}$ to $1\times10^{-5}$ mol, per mol of silver halide. The amount of the palladium compound is preferably from $5\times10^{-7}$ to $1\times10^{-3}$ mol, per mol of silver halide. The amount of the thiocyanate compound or the selenocyanate compound is preferably from $1\times10^{-6}$ to $5\times10^{-2}$ mol, per mol of silver halide.

The amount of the sulfur sensitization used for the silver halide grain of the present invention is preferably from $1\times10^{-7}$ to $1\times10^{-4}$, more preferably from $5\times10^{-7}$ to $1\times10^{-5}$ mol, per mol of silver halide.

The preferred sensitization for the emulsion of the present invention includes selenium sensitization. In the selenium sensitization, known labile selenium compounds are used and specific examples of the compound include colloidal metal selenium, selenoureas (e.g., N,N-dimethylselenourea, N,N-diethylselenourea), selenoketones and selenoamides. The selenium sensitization is preferably used in some cases in combination with sulfur sensitization, noble metal sensitization or both of these sensitizations.

The silver halide emulsion is preferably subjected to reduction sensitization during grain formation, before or during chemical sensitization after grain formation, or after chemical sensitization.

The reduction sensitization may be carried out by any of a method of adding a reduction sensitizer to the silver halide emulsion, a method of growing or ripening the emulsion in a low pAg atmosphere at a pAg of from 1 to 7 called silver ripening and a method of growing or ripening the emulsion in a high pH atmosphere at a pH of from 8 to 11 called high pH ripening. Two or more of the above-described methods may also be used in combination.

The method of adding a reduction sensitizer is preferred because the reduction sensitization level can be delicately controlled.

Known examples of the reduction sensitizer include a stannous salt, an ascorbic acid or a derivative thereof, amines and polyamines, a hydrazine derivative, a formamidinesulfinic acid, a silane compound and a borane compound. In the reduction sensitization of the present invention, a compound may be selected from these known reduction sensitizers or two or more compounds may also be used in combination. Preferred compounds as the reduction sensitizer include a stannous chloride, a thiourea dioxide, a dimethylamineborane and an ascorbic aid or a derivative thereof. The addition amount of the reduction sensitizer depends on the preparation condition of the emulsion and must be selected, however, it is suitably from $10^{-7}$ to $10^{-3}$ mol per mol of silver halide.

The reduction sensitizer is dissolved, for example, in water or a solvent such as an alcohol, a glycol, a ketone, an ester or an amide and then added during the grain growth. The reduction sensitizer may be added in advance to the reaction vessel but preferably it is added at an appropriate time during the grain growth. The reduction sensitizer may be added in advance to an aqueous solution of a water-soluble silver salt or a water-soluble alkali halide and the silver halide grain may be precipitated using the aqueous solution. Also, it is preferred to add the reduction sensitizer solution by several installments along the grain growth or to continuously add it over a long period of time.

In the light-sensitive material of the present invention, an oxidizing agent for silver is preferably used during the production process of emulsion. The oxidizing agent for silver as used herein means a compound capable of acting on a silver metal to convert it into a silver ion. In particular, a compound which converts very fine silver grains by-produced during grain formation of silver halide grains and chemical sensitization thereof into silver ions is effective. The silver ion produced here may be in the form of a difficultly water-soluble silver salt such as silver halide, silver sulfide or silver selenide or in the form of an easily water-soluble silver salt such as silver nitrate. The oxidizing agent for silver may be either an inorganic material or an organic material. Examples of the inorganic oxidizing agent include ozone, a hydrogen peroxide or an adduct thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), a peroxy acid salt (e.g., $K_2S_2O_8$, $K_2C_2O_6$, $K_2P_2O_8$), a peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2.6H_2O$), a permanganate (e.g., $KMnO_4$), an oxyacid salt such as a chromate (e.g., $K_2Cr_2O_7$), a halogen element such as iodine and bromine, a perhalogenic salt (e.g., potassium periodate), a salt of high-valence metal (e.g., potassium hexanocyanoferrate) and a thiosulfonate.

Examples of the organic oxidizing agent include quinones such as p-quinone, organic peroxides such as peracetic acid and perbenzoic acid, and active halogen-releasing compounds (e.g., N-bromosuccinimide, chloramine-T, chloramine-B).

Preferred as the oxidizing agent in the present invention are an inorganic oxidizing agent such as ozone, a hydrogen peroxide or an adduct thereof, a halogen element and a thiosulfonate and an organic oxidizing agent such as quinones. The oxidizing agent for silver is preferably used in combination with the above-described reduction sensitization. A method where an oxidizing agent is used and then reduction sensitization is conducted, a method reverse thereto or a method where the use of an oxidizing agent and the reduction sensitization concur may be appropriately selected. These methods may also be selected and used for the chemical sensitization during the grain formation.

Various compounds may be incorporated into the silver halide emulsion for use in the present invention so as to prevent fogging or to stabilize photographic capabilities, during preparation, storage or photographic processing of the light-sensitive material. More specifically, a large number of compounds known as an antifoggant or a stabilizer may be added, thiazoles such as benzothiazolium salts, nitroindazoles, nitrobenzimidazoles, chlorobenzimidazoles, bomobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole); mercaptopyrimidines; mercaptotriazines; thioketo compounds such as oxazolinethione; azaindenes such as triazaindenes, tetrazaindenes (in particular, 4-hydroxy-substituted (1,3,3a,7)tetrazaindenes) and pentazaindenes. For example, those described in U.S. Pat. Nos. 3,954,474 and 3,982,947 and JP-B-52-28660 (the term "JP-B" as used herein means an "examined Japanese patent publication") may be used. One preferred compound is the compound described in JP-A-63-212932. The antifoggant and the stabilizer each may be added at various stages such as before grain formation, during grain formation, after grain formation, at water washing, at dispersion after water washing, before chemical sensitization, during chemical sensitization, after chemical sensitization or before coating, depending upon the purpose. These compounds are added during the preparation of emulsion so as not only to exhibit antifogging and stabilization effects originally intended but also to work for various purposes such as control of crystal habit of a grain, reduction of grain size, reduction of solubility of a grain, control of chemical sensitization or control of dye orientation.

In order to exhibit the effect of the present invention, the silver halide emulsion for use in the present invention is preferably spectrally sensitized by a methine dye or others. Examples of the dye used include a cyanine dye, a merocyanine dye, a composite cyanine dye, a composite merocyanine dye, a holopolar cyanine dye, a hemicyanine dye, a styryl dye and a hemioxonol dye. Among these, particularly useful are dyes belonging to the cyanine dye, the merocyanine dye and the composite merocyanine dye. To these dyes, any nucleus commonly used for cyanine dyes as a basic heterocyclic nucleus can be applied. Examples of the nucleus include pyronine nucleus, oxazoline nucleus, thiazoline nucleus, pyrrole nucleus, oxazole nucleus, thiazole nucleus, selenazole nucleus, imidazole nucleus, tetrazole nucleus and pyridine nucleus; a nucleus resulting from fusion of an alicyclic hydrocarbon ring to the above-described nuclei; and a nucleus resulting from fusion of an aromatic hydrocarbon ring to the above-described nuclei, e.g., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei may have a substituent on the carbon atom thereof.

To the merocyanine dye or composite merocyanine dye, a 5- or 6-membered heterocyclic nucleus such as pyrazolin-5-one nucleus, thiohydantoin nucleus, 2-thioxazolidine-2,4-dione nucleus, thiazolidine-2,4-dione nucleus, rhodanine nucleus and thiobarbituric acid nucleus may be applied as a nucleus having a ketomethylene structure.

These sensitizing dyes may be used individually or in combination and the combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,946, 3,666,480, 3,672,898, 3,679,428, 3,703,377, 3,769,301, 3,814,609, 3,837,862 and 4,026,707, British Patent 1,344,281 and 1,507,803, JP-B-43-4936, JP-B-53-12375, JP-A-52-110618 and JP-A-52-109925.

In combination with a sensitizing dye, a dye which by itself does not have a spectral sensitization effect or a compound which absorbs substantially no visible light, but exhibits supersensitization may be contained in the emulsion.

The time when the spectral sensitizing dye is added to an emulsion may be any stage hitherto considered useful during preparation of the emulsion. Most commonly, the dye is added to the emulsion between after completion of chemical sensitization and before coating, but the dye may be added at the same time with a chemical sensitizer to effect spectral sensitization and chemical sensitization simultaneously as described in U.S. Pat. Nos. 3,628,969 and 4,225,666, the dye may be added in advance of chemical sensitization as described in JP-A-58-113928, or the dye may be added before the completion of silver halide grain formation by precipitation to start spectral sensitization. Further, the above-described compound may be added in installments, namely, a part of the compound may be added in advance of chemical sensitization and the remaining may be added after chemical sensitization as described in U.S. Pat. No. 4,225,666, and the compound may be added at any time during formation of silver halide grains as described in U.S. Pat. No. 4,183,756.

The addition amount of the spectral sensitizing dye may be from $4\times10^{-6}$ to $8\times10^{-3}$ mol. per mole of silver halide, however, when the silver halide grain size is from 0.2 to 1.2 μm as a more preferred embodiment, it is more effectively from about $5\times10^{-5}$ to $2\times10^{-3}$ mol. per mole of silver halide.

The light-sensitive material of the present invention uses various additives as described above but other than those, various additives may be used according to the purpose.

These additives are described in more detail in *Research Disclosure*, Item 17643 (December, 1978), ibid., Item 18716 (November, 1979) and ibid., Item 308119 (December, 1989) and the pertinent portions thereof are summarized in the table below.

| Kind of additives | RD17643 | RD18716 | RD308119 |
|---|---|---|---|
| 1. Chemical sensitizer | p. 23 | p. 648, right col. | p. 996 |
| 2. Sensitivity increasing agent | | " | |
| 3. Spectral sensitizer, supersensitizer | pp. 23–24 | p. 648, right col.-p. 649, right col. | p. 996, right col.-p. 998, right col. |
| 4. Whitening agent | p. 24 | | p. 998, right col. |
| 5. Antifoggant, stabilizer | pp. 24–25 | p. 649, right col. | p. 998, right col.-p. 1,000, right col. |
| 6. Light absorbent, filter dye, UV absorbent | pp. 25–26 | p. 649, right col.-p. 650, left col. | p. 1,003, left col.-p. 1,003, right col. |
| 7. Stain inhibitor | p. 25, right col. | p. 650, left to right cols. | p. 1,002, right col. |
| 8. Dye image stabilizer | p. 25 | | p. 1,002, right col. |
| 9. Hardening agent | p. 26 | p. 651, left col. | p. 1,004, right col.-p. 1,005, left col. |
| 10. Binder | p. 26 | " | p. 1,003, right col.-p. 1,004, |

-continued

| Kind of additives | RD17643 | RD18716 | RD308119 |
|---|---|---|---|
| 11. Plasticizer, lubricant | p. 27 | p. 650, right col. | right col. p. 1,006, left col.-p. 1,006, right col. |
| 12. Coating aid, surface active agent | pp. 26–27 | " | p. 1,005, left col.-p. 1,006, left col. |
| 13. Antistatic agent | p. 27 | " | p. 1006, right col.-p. 1,007, left col. |
| 14. Matting agent | | | p. 1,008, left col.-p. 1,009, left col. |

Various dye-forming couplers may be used in the light-sensitive material of the present invention but the following couplers are particularly preferred.

Yellow Coupler: Couplers represented by formula (I) or (II) of EP-A-502424; couplers represented by formula (1) or (2) of EP-A-513496 (particularly Coupler Y-28 at page 18); couplers represented by formula (I) in claim 1 of EP-A-568037; couplers represented by formula (I) in column 1, lines 45 to 55 of U.S. Pat. No. 5,066,576; couplers represented by formula (I) in paragraph 0008 of JP-A-4-24425; couplers described in claim 1 at page 40 of EP-A-498381 (particularly Coupler D-35 at page 18); couplers represented by formula (Y) at page 4 of EP-A-447969 (particularly Couplers Y-1 (p. 17) and Y-54 (p. 41)); and couplers represented by any one of formulae (II) to (IV) in column 7, lines 36 to 58 of U.S. Pat. No. 4,476,219 (particularly Couplers II-17 and II-19 (col. 17) and II-24 (col. 19)).

Magenta Couplers: Couplers L-57 (p. 11, right lower column), L-68 (p. 12, right lower column) and L-77 (p. 13, right lower column) of JP-A-3-39737; Couplers (A-4)-63 (p. 134), (A-4)-73 and (A-4)-75 (p. 139) of European Patent 456257; Couplers M-4, M-6 (p. 26) and M-7 (p. 27) of European Patent 486965; Coupler M-45 (p. 19) of EP-A-571959; Coupler M-1 (p. 6) of JP-A-5-204106; and Coupler M-22 in paragraph 0237 of JP-A-4-362631.

Cyan Couplers: Couplers CX-1, CX-3, CX-4, CX-5, CX-11, CX-12, CX-14 and CX-15 (pp. 14–16) of JP-A-4-204843; Couplers C-7, C-10 (p. 35), C-34, C-35 (p. 37), (I-1) and (I-17) (pp. 42–43) of JP-A-4-43345; and couplers represented by formula (Ia) or (Ib) in claim 1 of JP-A-6-67385.

Polymer Coupler: Couplers P-1 and P-5 (p. 11) of JP-A-2-44345.

As the coupler which provides a colored dye having appropriate diffusibility, those described in U.S. Pat. No. 4,366,237, British Patent 2,125,570, EP-B-96873 and West German Patent 3,234,533 are preferred.

As the coupler which corrects unnecessary absorption of the colored dye, yellow colored cyan couplers represented by formula (CI), (CII), (CIII) or (CIV) at page 5 of EP-A-456257 (particularly Coupler YC-86 at page 84), yellow colored magenta couplers ExM-7 (p. 202), EX-1 (p. 249) and EX-7 (p. 251) of EP-A-456257; magenta colored cyan couplers CC-9 (col. 8) and CC-13 (col. 10) of U.S. Pat. No. 4,833,069, coupler (2) (col. 8) of U.S. Pat. No. 4,837,136 and colorless masking couplers represented by formula (A) in claim 1 of WO92/11575 (particularly compounds at pp. 36–45) are preferred.

A compound (including a coupler) which releases a photographically useful residue by reacting with an oxidation product of the color developing agent includes the following: a development inhibitor-releasing compound such as compounds represented by formula (I), (II), (III) or (IV) at page 11 of EP-A-378236 (particularly, compounds T-101 (p. 30), T-104 (p. 31), T-113 (p. 33), T-131 (p. 45), T-144 (p. 51) and T-158 (p. 58)), compounds represented by formula (I) at page 7 of EP-A-436938 (particularly, compound D-49 (p. 51)), compounds represented by formula (I) of EP-A-568037 (particularly compound (23) (p. 11)) and compounds represented by formula (I), (II) or (III) at pages 5 to 6 of EP-A-440195 (particularly compound I-(1) at p. 29); a bleaching accelerator-releasing compound such as compounds represented by formula (I) or (I') at page 5 of EP-A-310125 (particularly compounds (60) and (61) at p. 61) and compounds represented by formula (I) in claim 1 of JP-A-6-59411 (particularly compound (7) (p. 7)); a ligand-releasing compound such as compounds represented by LIG-X in claim 1 of U.S. Pat. No. 4,555,478 (particularly compounds described in col. 12, lines 21–41); a leuco dye-releasing compound such as compounds 1 to 6 in columns 3 to 8 of U.S. Pat. No. 4,749,641; a fluorescent dye-releasing compound such as compounds represented by COUP-DYE in claim 1 of U.S. Pat. No. 4,774,181 (particularly compounds 1 to 11 in cols. 7–10); a development accelerator or fogging agent-releasing compound such as compounds represented by formula (1), (2) or (3) in column 3 of U.S. Pat. No. 4,656,123 (particularly compound (I-22) in col. 25) and ExZK-2 at page 75, lines 36 to 38 of EP-A-450637; and a compound releasing a group which becomes a dye first upon release such as compounds represented by formula (I) in claim 1 of U.S. Pat. No. 4,857,447 (particularly compounds Y-1 to Y-19 in cols. 25–36).

Preferred examples of additives other than couplers include the following.

A dispersion medium of an oil-soluble organic compound such as compounds P-3, P-5, P-16, P-19, P-25, P-30, P-42, P-49, P-54, P-55, P-66, P-81, P-85, P-86 and P-93 (pp. 140–144) of JP-A-62-215272; a latex for impregnation of an oil-soluble organic compound such as latexes described in U.S. Pat. No. 4,199,363; a scavenger for an oxidation product of a developing agent such as compounds represented by formula (I) in column 2, lines 54 to 62 of U.S. Pat. No. 4,978,606 (particularly compounds I-(1), I-(2), I-(6) and I-(12) (cols. 4–5)) and compounds represented by the formula in column 2, lines 5 to 10 of U.S. Pat. No. 4,923,787 (particularly compound 1 (col. 3)); a stain inhibitor such as compounds represented by any one of formulae (I) to (III) at page 4, lines 30 to 33 of EP-A-298321 (particularly compounds I-47, I-72, III-1 and III-27 (pp. 24–48)); a discoloration inhibitor such as compounds A-6, A-7, A-20, A-21, A-23, A-24, A-25, A-26, A-30, A-37, A-40, A-42, A-48, A-63, A-90, A-92, A-94 and A-164 (pp. 69–118) of EP-A-298321, compounds II-1 to III-23 in columns 25 to 38 of U.S. Pat. No. 5,122,444 (particularly compound III-10), compounds I-1 to III-4 at pages 8 to 12 of EP-A-471347 (particularly compound II-2) and compounds A-1 to A-48 in columns 32 to 40 of U.S. Pat. No. 5,139,931 (particularly compounds A-39 and A-42); a material able to reduce the use amount of a color reinforcing agent or a color mixing inhibitor such as compounds I-1 to II-15 at pages 5 to 24 of EP-A-411324 (particularly compound I-46); a formalin scavenger such as compounds SCV-1 to SCV-28 at pages 24 to 29 of EP-A-477932 (particularly compound SCV-8); a hardening agent such as compounds H-1, H-4, H-6, H-8 and H-14 at page 17 of JP-A-1-214845, compounds (H-1) to (H-54) represented by any one of formulae (VII) to (XII) in columns 13 to 23 of U.S. Pat. No. 4,618,573, compounds (H-1) to (H-76) represented by formula (6) at page 8, right lower column of JP-A-2-214852 (particularly compound H-14) and compounds described in claim 1 of U.S. Pat. No. 3,325,287; a development inhibitor precursor such as compounds P-24, P-37 and P-39 (pp. 6–7) of JP-A-62-168139; compounds described in claim 1 of U.S. Pat. No. 5,019,492 (particularly compounds 28 and 29 in col. 7); an antiseptic and an antimold such as compounds I-1 to III-43 in columns 3 to 15 of U.S. Pat. No. 4,923,790 (particularly compounds II-1, II-9, II-10, II-18 and III-25); a stabilizer and an antifoggant such as compounds I-1 to (14) in columns 6 to 16 of U.S. Pat. No. 4,923,793 (particularly compounds I-1, I-60, (2) and (13)) and compounds 1 to 65 in columns 25 to 32 of U.S. Pat. No. 4,952,483 (particularly compound 36); a chemical sensitizer such as triphenylphosphine, selenide and compound 50 of JP-A-5-40324; a dye such as compounds a-1 to b-20 at pages 15 to 18 (particularly compounds a-1, a-12, a-18, a-27, a-35, a-36, b-5) and compounds V-1 to V-23 at pages 27 to 29 (particularly compound V-1) of JP-A-3-156450, compounds F-I-1 to F-II-43 at pages 33 to 55 (particularly compounds F-I-11 and F-II-8) of EP-A-445627, compounds III-1 to III-36 at pages 17 to 28 of EP-A-457153 (particularly compounds III-1 and III-3), fine crystal dispersions of Dye-1 to Dye-124 at pages 8 to 26 of WO 88/04794, compounds 1 to 22 at pages 6 to 11 of EP-A-319999 (particularly compound 1), compounds D-1 to D-87 (pp. 3–28) represented by any one of formulae (1) to (3) of EP-A-519306A, compounds 1 to 22 (cols. 3–10) represented by formula (1) of U.S. Pat. No. 4,268,622 and compounds (1) to (31) (cols. 2–9) represented by formula (I) of U.S. Pat. No. 4,923,788; a UV absorbent such as compounds (18b) to (18r) and 101 to 427 (pp. 6–9) represented by formula (1) of JP-A-46-3335, compounds (3) to (66) (pp. 10–44) represented by formula (I) and compounds HBT-1 to HBT-10 (p. 14) represented by formula (III) of EP-A-520938 and compounds (1) to (31) (cols. 2–9) represented by formula (1) of EP-A-521823.

The present invention can be used as various color light-sensitive materials such as color negative film for general purpose or movies, color reversal film for slide or television, color paper, color positive film and color reversal paper. Also, it is suitable used for a film unit with lens described in JP-B-2-32615 and JP-U-B-3-39784 (the term "JP-U-B" as used herein means an "examined Japanese utility model publication").

Examples of the support suitable for use in the present invention include those described in RD No. 17643, page 28, ibid., No. 18716, from page 647, right column to page 648, left column and ibid., No. 307105, page 879.

In the light-sensitive material of the present invention, the total thickness of entire hydrophilic colloid layers on the side having emulsion layers is preferably 28 μm or less, more preferably 23 μm or less, still more preferably from 18 μm or less, particularly preferably 16 μm or less. The film swelling speed $T_{1/2}$ is preferably 30 seconds or less, more preferably 20 seconds or less. $T_{1/2}$ is defined as the time required to reach a half of the saturated film thickness which corresponds to 90% of the maximum swelled film thickness achieved in the processing with a color developer at 30° C. for 3 minutes and 15 seconds. The film thickness means the thickness of film measured under humidity conditioning (2 days) at 25° C. and 55% RH (relative humidity) and the swelling speed $T_{1/2}$ can be measured using a swellometer of a type described in A. Green et al, *Photoqr. Sci. Eng.*, vol. 19, 2, pp. 124–129. $T_{1/2}$ can be controlled by adding a hardening agent to gelatin as a binder or by changing the aging condition after coating. Also, the swelling ratio is preferably from 150 to 400%. The swelling ratio can be calculated from the maximum swelled film thickness obtained under conditions described above according to the expression: (maximum swelled film thickness—film thickness)/film thickness.

In the light-sensitive material of the present invention, a hydrophilic colloid layer (called back layer) having a total dry thickness of from 2° to 20 μm is preferably provided on the side opposite to the side having emulsion layers. This back layer preferably contains a light absorbent, a filter dye, an ultraviolet absorbent, an antistatic agent, a hardening agent, a binder, a plasticizer, a lubricant, a coating agent or a surface active agent which are described above. The back layer has a swelling rate of preferably from 150 to 500%.

The light-sensitive material of the present invention can be developed according to usual methods described in RD No. 17643, pp. 28–29, ibid., No. 18716, p. 651, from left to right columns and ibid., No. 307105, pp. 880–881.

The color developer for use in development of the light-sensitive material of the present invention is preferably an alkaline aqueous solution comprising as a main component an aromatic primary amine color developing agent. As the color developing agent, an aminophenol-based compound may be useful but a p-phenylenediamine-based compound is preferably used and representative and preferred examples thereof include compounds described in EP-A-556700, page 28, lines 43 to 52. These compounds can be used in combination of two or more thereof depending on the purpose.

The color developer usually contains a pH buffering agent such as a carbonate, a borate or a phosphate of an alkali metal or a development inhibitor or an antifoggant such as a chloride salt, a bromide salt, an iodide salt, a benzimidazole, a benzothiazole or a mercapto compound. The color developer may also contain, if desired, a preservative such as hydroxylamine, diethylhydroxylamine, sulfite, hydrazines (e.g., N,N-biscarboxymethylhydrazine), phenylsemicarbazides, triethanolamine and catecholsulfonic acids; an organic solvent such as ethylene glycol and diethylene glycol; a development accelerator such as benzyl alcohol, polyethylene glycol, a quaternary ammonium salt and amines; a dye-forming coupler; a competing coupler; an auxiliary developing agent such as 1-phenyl-3-pyrazolidone; a tackifying agent; and various chelating agents including aminopolycarboxylic acids, aminopolyphosphonic acids, alkylphosphonic acids and phosphonocarboxylic acids, such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene- 1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and a salt thereof.

In carrying out reversal processing, the color development usually follows black-and-white development. The black-and-white developer uses known black-and-white developing agents such as dihydoxybenzenes (e.g., hydroquinone), 3-pyrazolidones (e.g., 1-phenyl-3-pyrazolidone) and aminophenols (e.g., N-methyl-p-aminophenols) individually or in combination. The color developer or the black-and-white developer usually has a pH of from 9 to 12. The replenishing amount of these developers is, although it may vary depending on the color photographic light-sensitive material to be processed, generally 3 l or less per $m^2$ of the light-sensitive material and when the bromide ion concentration of the replenisher is lowered, the replenishing amount may be reduced to 500 ml or less. When the replenishing amount is reduced, the contact area of the processing tank with air is preferably reduced to prevent evaporation of the solution or air oxidation.

The processing effect resulting from contact of the photographic processing solution with air in a processing tank can be evaluated by an open ratio (={contact area of the processing solution with air ($cm^2$)}÷{volume of the processing solution ($cm^3$)}. The open ratio as defined above is preferably 0.1 or less, more preferably from 0.001 to 0.05. The open ratio can be reduced, for example, by a method of providing a shielding material such as a floating lid on the surface of the photographic processing solution in the processing tank, by a method of using a movable lid described in JP-A-1-82033 or by a slit development processing method described in JP-A-63-216050. The open ratio is preferably reduced not only in both steps of color development and black-and-white development but also in all subsequent steps such as bleaching, bleach-fixing, fixing, water washing and stabilization. Further, by using a means for suppressing the accumulation of bromide ions in the developer, the replenishing amount can be reduced.

The color development time is usually set to from 2 to 5 minutes, however, more reduction in the processing time can be achieved by setting the conditions at a high temperature and a high pH and using a color developing agent in a high concentration.

After the color development, the photographic emulsion layer is usually subjected to bleaching. The bleaching may be conducted at the same time with the fixing (bleach-fixing) or may be conducted separately. For the purpose of rapid processing, the bleaching may be followed by bleach-fixing. Further, a processing in a bleach-fixing bath consisting of two continuous tanks, a fixing processing before bleach-fixing or a bleaching processing after bleach-fixing may be freely conducted depending upon the purpose. Examples of the bleaching agent include compounds of a polyvalent metal such as iron(III), peracids, quinones and nitro compounds. Representative examples of the bleaching agent include organic complex salts of iron(III), e.g., complex salts with an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid, or with citric acid, tartaric acid or malic acid. Among these, an aminopolycarboxylic acid ferrate complex salt including an ethylenediaminetetraacetato ferrate complex salt and 1,3-diaminopropanetetraacetato ferrate complex salt is preferred in view of rapid processing and prevention of environmental pollution. Further, the aminopolycarboxylic acid ferrate complex salt is particularly useful for the bleaching solution and for bleach-fixing solution. The bleaching solution or the bleach-fixing solution using the aminopolycarboxylic acid ferrate complex salt has a pH of generally from 4.0 to 8 but the processing may be carried out at a lower pH for expediting the processing.

A bleaching accelerator may be used, if desired, in the bleaching solution, the bleach-fixing solution or a prebath thereof. Specific examples of useful bleaching accelerators include compounds described in the following specifications: compounds having a mercapto group or a disulfide group described in U.S. Pat. No. 3,893,858, German Patent 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and RD No. 17129 (July, 1978); thiazolidine derivatives described in JP-A-50-140129; thiourea derivatives described in JP-B-45-8506, JP-A-52-20832, JP-A-53-32735 and U.S. Pat. No. 3,706,561; iodide salts described in German Patent 1,127,715 and JP-A-58-16235; polyoxyethylene compounds described in German Patent 966,410 and 2,748,430; polyamine compounds described in JP-B-45-8836; compounds described in JP-A-49-40943, JP-A-49-59644, JP-A-53-94927, JP-A-54-35727, JP-A-55-26506 and JP-A-58-163940; and bromide ions. Among these, compounds having a mercapto group or a disulfide group are preferred in view of a large acceleration effect and in particular, compounds described in U.S. Pat. No. 3,893,858, German Patent 1,290,812 and JP-A-53-95630 are preferred. Also, compounds described in U.S. Pat. No. 4,552,834 are preferred. The bleaching accelerator may also be incorporated into the light-sensitive material. The bleaching accelerator is particularly effective in bleach-fixing a color light-sensitive material for photographing.

In addition to the above-described compounds, the bleaching solution or the bleach-fixing solution preferably contains an organic acid for the purpose of preventing bleaching stain. Particularly preferred examples of the organic acid include compounds having an acid dissociation constant (pKa) of from 2 to 5 and specific examples thereof include acetic acid, propionic acid and hydroxyacetic acid.

Examples of the fixing agent for use in the fixing solution or the bleach-fixing solution include thiosulfates, thiocyanates, thioether-based compounds, thioureas and a large quantity of iodides. Among these, thiosulfates are commonly used and an ammonium thiosulfate can be used most widely. Also, a combination use of a thiosulfate with a thiocyanate, a thioether-based compound or a thiourea is preferred. As the preservative for the fixing solution or the bleach-fixing solution, sulfites, bisulfites, carbonyl bisulfite adducts, and sulfinic acid compounds described in EP-A-294769 are preferred. Further, the fixing solution or the bleach-fixing solution preferably contains aminopolycarboxylic acids or organic phosphonic acids for the purpose of stabilization of the solution.

In the present invention, the fixing solution or the bleach-fixing solution contains, in order to adjust the pH, a compound having a pKa of from 6.0 to 9.0, preferably, an imidazole such as imidazole, 1-methylimidazole, 1-ethylimidazole and 2-methylimidazole, in an amount of from 0.1 to 10 mol/liter.

The total desilvering time is preferably as short as possible if a desilvering failure is not caused. The time is preferably from 1 to 3 minutes, more preferably from 1 to 2 minutes. The processing temperature is from 25° to 50° C., preferably from 35° to 45° C. In this preferred temperature range, the desilvering rate is improved and the occurrence of stains after processing can be effectively prevented.

In desilvering, the stirring is preferably intensified as highly as possible. Specific examples of the method for intensifying stirring include a method of colliding a jet stream of a processing solution against the emulsion surface of the light-sensitive material described in JP-A-62-183460, a method of increasing the stirring effect using a rotary means described in JP-A-62-183461, a method of increasing the stirring effect by moving the light-sensitive material while putting the emulsion surface into contact with a wire blade provided in the solution to cause turbulence on the emulsion surface, and a method of increasing the circulation flow rate of the entire processing solutions. Such a means for intensifying the stirring is effective in any of the bleaching solution, the bleach-fixing solution and the fixing solution. The intensification of stirring is considered to speed up the supply of the bleaching agent or the fixing agent into the emulsion layer and as a result, to elevate the desilvering rate. The above-described means for intensifying stirring is more effective when a bleaching accelerator is used and in this case, the acceleration effect can be outstandingly increased or the fixing inhibitory action due to the bleaching accelerator can be eliminated.

The automatic developing machine used for the light-sensitive material of the present invention preferably has a transportation means of a light-sensitive material described in JP-A-60-191257, JP-A-60-191258 and JP-A-60-191259. As described in JP-A-60-191257 above, the transportation means can extremely decrease the amount of a processing solution carried over from a previous bath to a post bath, provides a great effect in preventing the deterioration in capacity of the processing solution and is particularly effective in reducing the processing time or decreasing the replenishing amount of a processing solution in each step.

The light-sensitive material of the present invention is generally subjected to water washing and/or stabilization after desilvering. The amount of water in water washing can be set over a wide range according to the characteristics (e.g., due to the material used such as a coupler) or the use of the photographic material and in addition, the temperature of washing water, the number of water washing tanks (stage number), the replenishing system such as countercurrent and co-current or other various conditions. Among these, the relation between the number of water washing tanks and the amount of water in a multi-stage countercurrent system can be obtained according to the method described in *Journal of the Society of Motion Picture and Television Engineers*, Vol. 64, pp. 248–253 (May, 1995). According to the multi-stage countercurrent system described in the above-described publication, the amount of washing water may be greatly reduced but due to the increase in the residence time of water in the tank, a problem is caused such that bacteria proliferate and the floats generated adhere to the light-sensitive material. In order to solve such a problem, a method of reducing calcium ions or magnesium ions described in JP-A-62-288838 can be very effectively used. Further, isothiazolone compounds and thiabendazoles described in JP-A-57-8542, chlorine-based germicides such as sodium chlorinated isocyanurate, benzotriazoles or germicides described in Hiroshi Horiguchi, *Bokin, Bobai-Zai no Kagaku*, Sankyo Shuppan (1986), *Biseibutsu no Mekkin, Sakkin, Bobai-Gijutsu* compiled by Eisei Gijutsu Kai, issued by Kogyo Gijutsu Kai (1982), and *Bokin-Bobai Zai Jiten* compiled by Nippon Bokin Bobai Gakkai (1986) can also be used.

The washing water in the processing of the light-sensitive material of the present invention usually has a pH of from 4 to 9, preferably from 5 to 8. The temperature and the processing time of water washing may be set variously according to the characteristics and use of the light-sensitive material, but, they are commonly from 15° to 45° C. and from 20 seconds to 10 minutes, preferably from 25° to 40° C. and from 30 seconds to 5 minutes, respectively. The light-sensitive material of the present invention may also be processed directly with a stabilizing solution in place of the above-described water washing. In such a stabilization processing, known methods described in JP-A-57-8543, JP-A-58-14834 and JP-A-60-220345 can be used.

In some cases, the stabilization processing is further carried out after the above-described water washing. An example thereof is a stabilization bath containing a dye stabilizing agent and a surface active agent used as a final bath of a color light-sensitive material for photographing. Examples of the dye stabilizing agent include aldehydes such as formalin and glutaraldehyde, N-methylol compounds and hexamethylenetetramine, and aldehyde sulfite addition products. This stabilization bath may also contain various chelating agents and antimolds.

The overflow solution accompanying the replenishing of the above-described washing water and/or stabilization solution can be re-used in other processing steps such as desilvering.

In the processing using an automatic developing machine, if the above-described respective processing solutions are concentrated due to evaporation, water is preferably added to correct the concentration.

A color developing agent may be incorporated into the light-sensitive material of the present invention so as to simplify and expedite the processing. The color developing agent is preferably incorporated into the light-sensitive material in the form of a precursor. Examples of the precursor include indoaniline compounds described in U.S. Pat. No. 3,342,597, Schiff base-type compounds described in U.S. Pat. No. 3,342,599, *Research Disclosure* No. 14850 and ibid., No. 15159, aldol compounds described in ibid., No. 13924, metal salt complexes described in U.S. Pat. No. 3,719,492 and urethane-based compounds described in JP-A-53-135628.

The light-sensitive material of the present invention may contain, if desired, various 1-phenyl-3-pyrazolidones for the purpose of accelerating the color development. Typical examples of the compound are described in JP-A-56-64339, JP-A-57-144547 and JP-A-58-115438.

Each processing solution used for processing the light-sensitive material of the present invention is usually used at a temperature of from 10 to 50° C. Usually, the temperature as a standard is from 33° to 38° C. but higher temperatures may be used to accelerate the processing to thereby reduce the processing time or on the contrary, lower temperatures may be used to achieve improved image quality or improved stability of the processing solution.

The transparent magnetic recording layer which can be used in the present invention is described below.

The transparent magnetic recording layer which can be used in the present invention is provided by coating an aqueous or organic solvent-based coating solution containing a binder having dispersed therein magnetic particles on a support.

The magnetic particle which can be used includes a ferromagnetic iron oxide (e.g., $\gamma Fe_2O_3$), Co-doped $\gamma Fe_2O_3$, Co-doped magnetite, Co-containing magnetite, ferromagnetic chromium dioxide, ferromagnetic metal, ferromagnetic alloy, hexagonal Ba ferrite, Sr ferrite, Pb ferrite and Ca ferrite. Among these, a Co-doped ferromagnetic iron oxide such as Co-doped $\gamma Fe_2O_3$ is preferred. The form of the magnetic particle may be any of acicular, rice grain-like, spherical, cubic and platy forms. The specific surface area as $S_{BET}$ is preferably 20 $m^2/g$ or more, more preferably 30 $m^2/g$ or more. The saturation magnetization ($\sigma s$) of the ferromagnetic material is preferably from $3.0\times10^4$ to $3.0\times10^5$ A/m, more preferably from $4.0\times10^4$ to $2.5\times10^5$ A/m. The ferromagnetic particle may be subjected to surface treatment with silica and/or alumina or an organic material. Further, the ferromagnetic particle may be subjected to surface treatment with a silane coupling agent or a titanium coupling agent as described in JP-A-6-161032. Also, a magnetic material having coated on the surface thereof an inorganic or organic material described in JP-A-4-259911 and JP-A-5-81652 may be used.

The binder for use in the magnetic particle includes a thermoplastic resin, a thermosetting resin, a radiation-curable resin, a reactive resin, an acid, alkali or biodegradable polymer, a natural polymer (e.g., cellulose derivative, saccharide derivative) and a mixture of these described in JP-A-4-219569. The above-described resin has a Tg of from −40° C. to 300° C. and a weight average molecular weight of from 2,000 to 1,000,000. Examples of the resin include a vinyl copolymer, a cellulose derivative such as cellulose diacetate, cellulose triacetate, cellulose acetate propionate, cellulose acetate butyrate and cellulose tripropionate, an acrylic resin and a polyvinyl acetal resin, and gelatin is also preferably used. Among these, cellulose di(tri)acetate is preferred. The binder may cured by adding thereto an epoxy-based, aziridine-based or isocyanate-based crosslinking agent. Examples of the isocyanate-based crosslinking agent include isocyanates such as tolylenediisocyanate, 4,4'-diphenylmethanediisocyanate, hexamethylenediisocyanate and xylylenediisocyanate, a reaction product of these isocyanates with polyalcohol (e.g., a reaction product of 3 mol of tolylenediisocyanate with 1 mol of trimethylol propane) and a polyisocyanate produced by the condensation of these isocyanates, which are described, for example, in JP-A-6-59357.

The ferromagnetic material is dispersed into the binder by the method preferably using a kneader, a pin-type mill or an annular-type mill as described in JP-A-6-35092 and these may also be preferably used in combination. The dispersant described in JP-A-5-088283 and other known dispersants may be used. The thickness of the magnetic recording layer is from 0.1 to 10 μm, preferably from 0.2 to 5 μm, more preferably from 0.3 to 3 μm. The weight ratio of the magnetic particle to the binder is preferably from 0.5:100 to 60:100, more preferably from 1:100 to 30:100. The coating amount of magnetic particles is from 0.005 to 3 g/m$^2$, preferably from 0.01 to 2 g/m$^2$, more preferably from 0.02 to 0.5 g/m$^2$. The magnetic recording layer which can be used in the present invention may be provided throughout the entire surface or stripe-like on the back surface of the photographic support by coating or printing. The coating of the magnetic recording layer can use air doctor, blade, air knife, squeeze, soak, reverse roller, transfer roller, gravure, kiss, cast, spray, dip, bar or extrusion, and the coating solution described in JP-A-5-341436 is preferred.

The magnetic recording layer may be designed to have additional functions such as improvement of lubricity, control of curl, electrostatic charge prevention, prevention of adhesion or head abrasion, or other functional layers may be provided to undertake these functions. At least one or more of particles is preferably an abrasive as an aspheric inorganic particle having a Mhos' hardness of 5 or more. The composition of the aspheric inorganic particle is preferably an oxide such as aluminum oxide, chromium oxide, silicon dioxide or titanium dioxide, a carbide such as silicon carbide or titanium carbide, or a fine particle of diamond. The abrasive may be subjected to surface treatment with a silane coupling agent or a titanium coupling agent. The particles may be added to a magnetic recording layer or may be overcoated on the magnetic recording layer (for example, as protective layer or a lubricant layer). The binder used here may be those described above and it is preferably the same as the binder in the magnetic recording layer. The light-sensitive material having a magnetic recording layer is described in U.S. Pat. Nos. 5,336,589, 5,250,404, 5,229,259 and 5,215,874 and European Patent 466130.

The support for use in the present invention, in particular, the polyester support is described below. The details thereon including the light-sensitive material, the processing, the cartridge and the working examples are described in *JIII Journal of Technical Disclosure* No. 94-6023 (Mar. 15, 1994). The polyester for use in the present invention is formed using a diol and an aromatic dicarboxylic acid as essential components. Examples of the aromatic dicarboxylic acid include 2,6-naphthalenedicarboxylic acid, 1,5-naphthalenedicarboxylic acid, 1,4-naphthalenedicarboxylic acid, 2,7-naphthalenedicarboxylic acid, terephthalic acid, isophthalic acid and phthalic acid, and examples of the diol include diethylene glycol, triethylene glycol, cyclohexanedimethanol, bisphenol A and biphenol. The polymer polymerized from these includes a homopolymer such as polyethylene terephthalate, polyethylene naphthalate and polycyclohexanedimethanol terephthalate. Among these, preferred is a polyester containing from 50 to 100 mol % of 2,6-naphthalenedicarboxylic acid. Particularly preferred is polyethylene 2,6-naphthalate. The average molecular weight is approximately from 5,000 to 200,000. The polyester of the present invention has a Tg of 50° C. or higher, more preferably 90° C. or higher.

The polyester support is then subjected to heat treatment to have an aversion to having curling habit at a heat treatment temperature of from 40° C. to less than Tg, more preferably from (Tg−20° C.) to less than Tg. The heat treatment may be conducted either at a constant temperature within the above-described range or while cooling. The heat treatment time is from 0.1 to 1,500 hours, more preferably from 0.5 to 200 hours. The support may be subjected to heat treatment either in a state of roll or as a web on the way of conveyance. The surface may be made uneven (for example, by coating electrically conductive inorganic fine particles such as $SnO_2$ or $Sb_2O_5$)) to improve the surface state. Also, it is preferred to make some designs such that the edge is knurled to slightly increase the height only of the edge, thereby preventing the cut copy at the core portion. The heat treatment may be conducted at any stage of after formation of support film, after surface treatment, after coating of a back layer (e.g., antistatic agent, slipping agent) and after coating of an undercoat layer. The preferred stage is after coating of an antistatic agent.

Into the polyester, an ultraviolet absorbent may be kneaded in. Or, for preventing light piping, a commercially available paint or pigment for polyester, such as Diaresin produced by Mitsubishi Chemicals Industries, Ltd. or Kayaset produced by Nippon Kayaku K.K., may be mixed so as to attain the object.

In the present invention, the surface treatment is preferably conducted so that the support can be bonded to the light-sensitive constituent layer. Examples of the surface activation treatment include chemical treatment, mechanical treatment, corona discharge treatment, flame treatment, ultraviolet light treatment, high frequency treatment, glow discharge treatment, active plasma treatment, laser treatment, mixed acid treatment and ozone oxidation treatment. Among these surface treatments, preferred are ultraviolet irradiation treatment, flame treatment, corona treatment and glow treatment.

The undercoating method is described below. The undercoating may be single layer coating or two or more layer coating. The binder for the undercoat layer includes a copolymer starting from a monomer selected from vinyl chloride, vinylidene chloride, butadiene, methacrylic acid, acrylic acid, itaconic acid and maleic anhydride, and in addition, polyethyleneimine, epoxy resin, grafted gelatin, nitrocellulose and gelatin. The compound which swells the support include resorcin and p-chlorophenol. The undercoat layer may contain a gelatin hardening agent and examples thereof include chromic salts (e.g., chrome alum), aldehydes (e.g., formaldehyde, glutaraldehyde), isocyanates, active halogen compounds (e.g., 2,4-dichloro-6-hydroxy-S-triazine), epichlorohydrin resin and active vinyl sulfone compounds. Further, the undercoat layer may contain an inorganic fine particle such as $SiO_2$ or $TiO_2$, or a polymethyl methacrylate copolymer fine particle (0.01 to 10 μm), as a matting agent.

In the present invention, an antistatic agent is preferably used. Examples of the antistatic agent include a high polymer containing a carboxylic acid, a carboxylate or a sulfonate, a cationic high polymer and an ionic surface active agent compound.

Most preferred antistatic agents are a fine particle of at least one crystalline metal oxide having a volume resistivity of $10^7$ Ω·cm or less, more preferably $10^5$ Ω·cm or less and a particle size of from 0.001 to 1.0 μm, selected from ZnO, $TiO_2$, $SnO_2$, $Al_2O_3$, $In_2O_3$, $SiO_2$, MgO, BaO, $MoO_3$ and $V_2O_5$, or of a composite oxide of these (e.g., Sb, P, B, In, S, Si, C), and a fine particle of a sol-like metal oxide or of a composite oxide of these. The content of the antistatic agent in the light-sensitive material is preferably from 5 to 500 mg/m$^2$, more preferably from 10 to 350 mg/M. The ratio of the electrically conductive crystalline oxide or a composite oxide thereof to the binder is preferably from 1/300 to 100/1, more preferably from 1/100 to 100/5.

The light-sensitive material of the present invention preferably has a slipperiness. The slipping agent-containing layer is preferably provided on both of the light-sensitive layer surface and the back surface. The preferred slipperiness is in terms of a coefficient of dynamic friction, from 0.01 to 0.25. The value is determined using a stainless steel ball having a diameter of 5 mm by transporting the light-sensitive material at a speed of 60 cm/min (25° C., 60% RH). In this evaluation, even when the other party is changed to the light-sensitive layer surface, the value almost on the same level is obtained.

The slipping agent which can be used in the present invention includes polyorganosiloxane, a higher fatty acid amide, a higher fatty acid metal salt and an ester of a higher fatty acid with a higher alcohol. Examples of the polyorganosiloxane include polydimethylsiloxane, polydimethylsiloxane, polystyrylmethylsiloxane and polymethylphenylsiloxane. The layer to be added is preferably an outermost layer of the emulsion layer or a back layer. In particular, polydimethylsiloxane and an ester having a long chain alkyl group are preferred.

The light-sensitive material of the present invention preferably contains a matting agent for the purpose of preventing adhesion failure. The matting agent may be provided either on the emulsion surface or on the back surface, but it is particularly preferably added to the outermost layer on the emulsion layer side. The matting agent may be either soluble or insoluble in the processing solution, and preferably, both of a processing solution-soluble matting agent and a processing solution-insoluble matting agent are used at the same time. For example, polymethyl methacrylate, poly (methyl methacrylate/methacrylic acid=9/1 or 5/5 (by mol)) and polystyrene particles are preferred. The particle size is preferably from 0.8 to 10 μm, the particle size distribution is preferably narrower, and 90% by number or more of all particles preferably have a size between 0.9 and 1.1 times the average particle size. In order to increase the matting property, fine particles of 0.8 μm or less are preferably added at the same time and examples thereof include polymethyl methacrylate (0.2 μm), poly(methyl methacrylate/methacrylic acid=9/1 (by mol), 0.3 μm), polystyrene particles (0.25 μm) and colloidal silica (0.03 μm).

The film patrone which can be used for the light-sensitive material of the present invention is described below. The patrone may a metal or a synthetic plastic as a main material.

Preferred plastic materials are polystyrene, polyethylene, polypropylene and polyphenyl ether. The patrone of the present invention may further contain various antistatic agents and preferred examples thereof include carbon black, a metal oxide particle, a nonionic, anionic, cationic or betaine surface active agent and a polymer. The patrone imparted with the antistatic property using these is described in JP-A-1-312537 and JP-A-1-312538. In particular, the resistance at 25° C. and 25% RH is preferably $10^{12}$ Ω or less. Usually, the plastic patrone is produced using a plastic having kneaded therein carbon black or a pigment so as to give light-shielding property. The patrone may be in a 135 size currently used but, in achieving down-sizing of camera, it is also effective to reduce the cartridge size from 25 mm of 135 size currently populated to 22 mm or less. The volume of the patrone case is preferably 30 cm$^3$ or less, more preferably 25 cm$^3$ or less. The weight of plastics used in the patrone and the patrone case is preferably from 5 to 15 g.

The patrone for the light-sensitive material of the present invention may be a patrone which sends forth the film by the rotation of a spool. Also, the patrone may have such a constitution that a film leading end is housed in the patrone body and the film leading end is sent forth from the port part of the patrone to the outside by rotating the spool shaft in the film delivery direction. These are disclosed in U.S. Pat. Nos. 4,834,306 and 5,226,613. The photographic film may be a so-called green film before development or a developed photographic film. Also, a green film and a developed photographic film may be housed in the same new patrone or in different patrones.

The number of perforations formed on the silver halide color photographic light-sensitive material, the picture and the image area are described below by referring to the drawings attached.

In one embodiment of the silver halide color photographic light-sensitive material of the present invention, the perforations are formed on one or both of side edge parts in the length direction of a support in the roll form. A structure may be taken such that the perforations are formed on one side edge part and the other side edge part may be used to record thereon information at the time of preparation of the light-sensitive material or information regarding the exposure condition in photographing, for example, by a magnetic means or an optical means. When the perforations are formed on both side edge parts, the above-described information may be recorded between one perforation and another perforation.

The constitutional examples of the light-sensitive material are shown in FIG. 1 to FIG. 9.

FIG. 1 to FIG. 8 each is a plan view showing a part of an example of the light-sensitive material according to the present invention. FIG. 9 is a view showing a cross section in the thickness direction of the film shown in FIG. 1 to FIG. 8.

As shown in FIG. 1 to FIG. 8, the film is a belt-like lengthy material and constituted by a picture (image part) 1 formed by photographing (exposure) and frame parts 2 and 3 formed at both side edge parts of the picture 1 in the width direction of the film, respectively. The frame parts 2 and 3 preferably function as an information recording part and for example, an optical information part or a magnetic recording part comprising a magnetic recording layer is formed thereon. More specifically, in the frame part 2, a magnetic recording track 4 may be formed along the longitudinal direction of Film F. The magnetic recording track 4 is formed, as shown in FIG. 9, by coating a magnetic substance 7 on the surface of film F opposite to the surface where a hydrophilic colloid layer 8 is provided but it may be formed on the surface where the hydrophilic colloid layer 8 is provided. Further, the magnetic recording track 4 may be provided on the frame part 3 or both side edge parts (namely, frame parts 2 and 3). On this magnetic recording track 4, for example, the name of manufacturer, the type of film, the date of preparation, the frame number, information inherent to the film such as positioning of one frame part, the date of photographing, the presence or absence of flash, the shutter speed, information for photographing such as diaphragm of a lens, the name of color laboratory company, the name of color development processing formulation, the name of development equipment, the date of processing, the name of person in charge of processing or information for laboratory processing such as exposure conditions on a color paper (hereinafter, these are simply referred to as information) are magnetically recorded per one roll of film or per one image, at the time of film preparation, photographing or film processing.

In reading the information recorded on the magnetic recording track 4, the film F is transported in the longitudinal direction and while putting a reading means, for example, a magnetic head into contact with the magnetic recording track 4, the information is taken out as electric signals.

On the other hand, in the frame part 3, perforations 5 are formed for feeding film or fitting positions in a camera.

In this case, it is preferred to reduce the number of perforations. In a camera currently used, the film is transported using perforations, accordingly, if other film transportation mechanism using no perforation is adopted and only perforations in number necessary for the positioning in a camera or in a printer are left, the number of perforations can be reduced. The number of perforations is preferably from 1 to 4, more preferably from 1 or 2, per one picture ($S_1$). The term "one picture" as used herein means the area corresponding to A×B in a film shown in FIG. 2.

In the practical embodiment of the light-sensitive material of the present invention, as shown in FIGS. 1, 2, 4 and 6, perforations 5 may be provided in the frame part 2 or 3 formed on the side edge parts in the width direction of film F and also, as shown in FIGS. 3, 5, 7 and 8, they may be provided in both of the frame parts 2 and 3.

Figure 2:
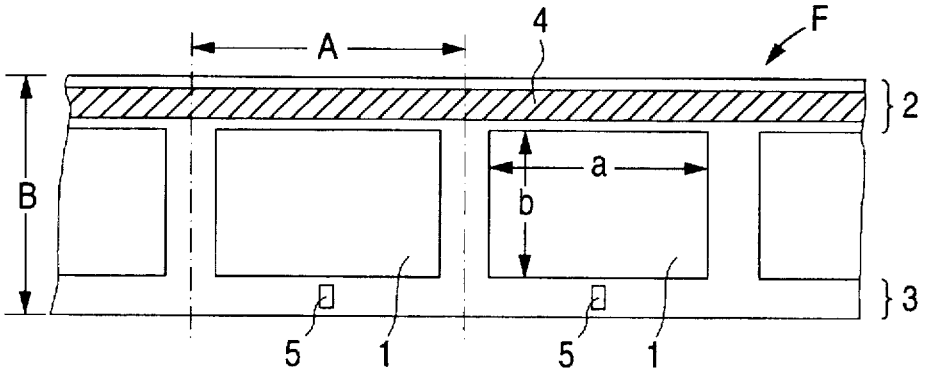
FIG. 2 is a plan view showing a part of the constitution according to another embodiment of a film prepared using the light-sensitive material of the present invention, where one square perforation was formed on one side edge part of the film per one picture.
Figure 3:
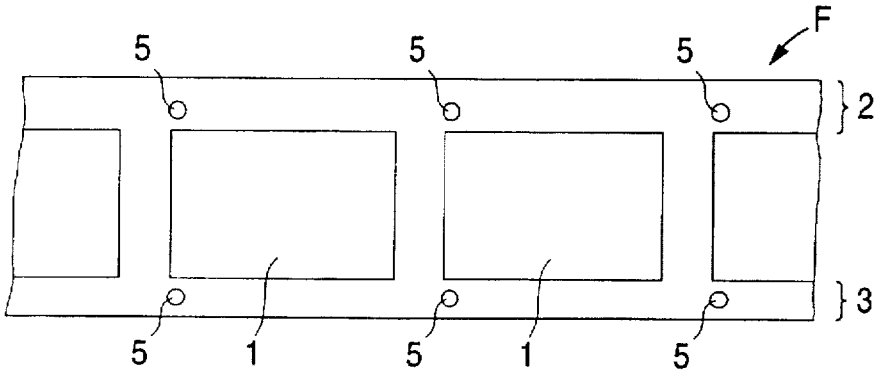
FIG. 3 is a plan view showing a part of the constitution according to another embodiment of a film prepared using the light-sensitive material of the present invention, where two circular perforations were formed on both side edge parts of the film per one picture.
Figure 4:
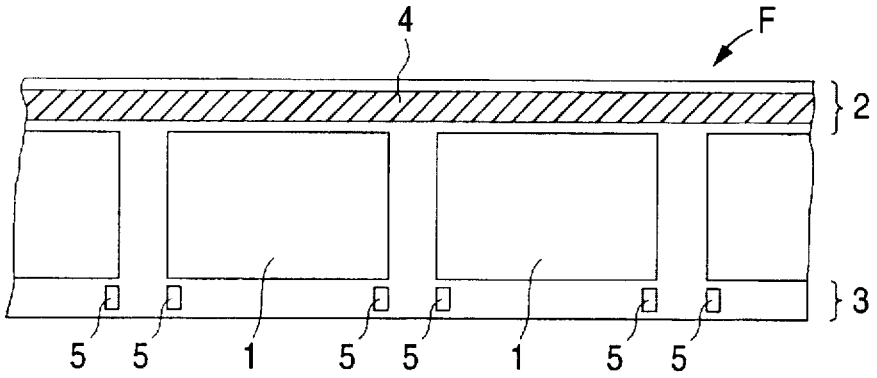
FIG. 4 is a plan view showing a part of the constitution according to another embodiment of a film prepared using the light-sensitive material of the present invention, where two square perforations were formed on one side edge part of the film per one picture.
Figure 5:
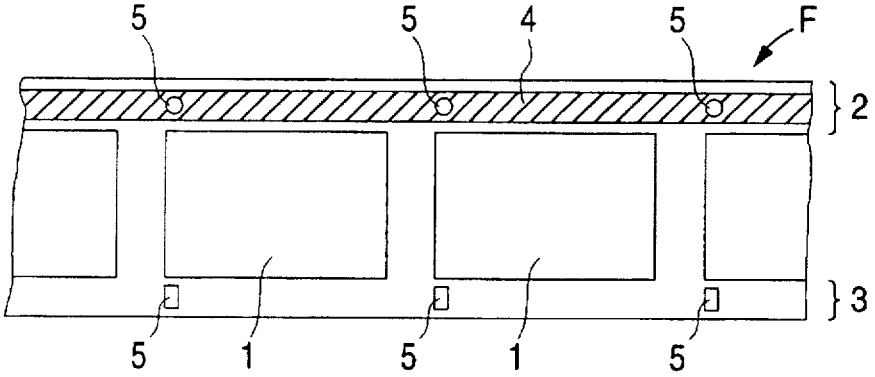
FIG. 5 is a plan view showing a part of the constitution according to another embodiment of a film prepared using the light-sensitive material of the present invention, where one perforation was formed on both side edge parts of the film per one picture, the shape of perforations formed on one side edge part is square and the other is circular.
Figure 6:
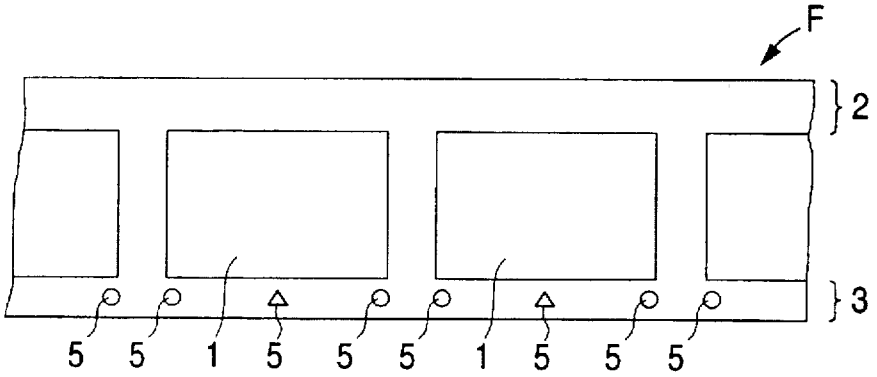
FIG. 6 is a plan view showing a part of the constitution according to another embodiment of a film prepared using the light-sensitive material of the present invention, where three perforations were formed on one side edge part of the film per one picture and the shape of perforations is circular and triangular.
Figure 7:
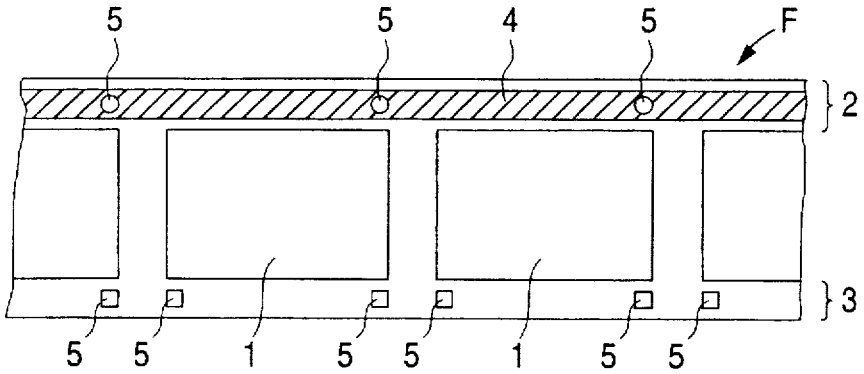
FIG. 7 is a plan view showing a part of the constitution according to another embodiment of a film prepared using the light-sensitive material of the present invention, where three perforations were formed on both side edge parts of the film per one picture and the shape of perforations is circular and square.
Figure 8:
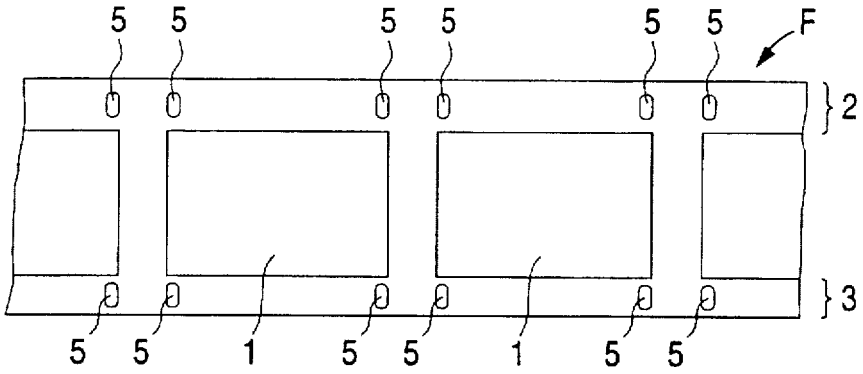
FIG. 8 is a plan view showing a part of the constitution according to another embodiment of a film prepared using the light-sensitive material of the present invention, where four elliptical perforations were formed on both side edge parts of the film per one picture.
Figure 9:
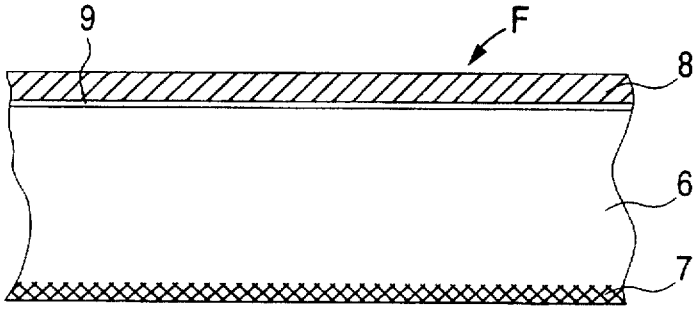
FIG. 9 is a view showing a cross section in the thickness direction of the film shown in FIGS. 1 to 8.

The shape of a perforation is not particularly limited and various shapes, for example, as in FIGS. 1, 2 and 4, square or angular such as hexagon (provided that the corners of an angular perforation may form a curve having a constant radius of curvature) or, as in FIGS. 3 and 8, circular (ellipse or other modified circle) shape may be used. Further, when a plurality of perforations are provided per one picture, the shape of these perforations in plurality may be the same as in FIGS. 3, 4 and 8 or may be different as in FIGS. 5, 6 and 7.

The size of a perforation is either not particularly limited, however, in view of function of frame parts 2 and 3 as an information recording part, it is preferably small. The occupancy ratio of perforations in the total area is 5% or less, preferably 3% or less, more preferably from 0.1 to 2%, per one picture area ($A \times B = S_1$ in FIG. 2).

In the present invention, in order to secure the area of an optical or magnetic information recording part, the area of an image part (a picture in the exposure part) is set to 3 to 7 $cm^2$, particularly preferably from 4.0 to 6.0 $cm^2$.

The length of belt-like lengthy film F is 200 cm or less, preferably 180 cm or less, more preferably 165 cm or less, particularly preferably 150 cm or less. The lower bound of the length of film F is 40 cm. The width of film F is 35 mm or less, preferably 10 to 32 mm, particularly preferably 15 to 30 mm.

On the other hand, as a result of various investigations, it is found that if a print having the following three kinds of aspect ratio (ratio of transverse length/longitudinal length of an image part), variation in the composition of photographs greatly increases. That is, the following three aspect ratios:

| | |
|---|---|
| (1) low aspect ratio | 1.40 to 1.60 |
| (2) medium aspect ratio | 1.70 to 1.90 |
| (3) high aspect ratio | 2.00 to 3.00 |

Of course, the kinds of prints may be increased.

When the aspect ratio (ratio b/a in FIG. 2) of an image part (picture in the exposure part) of a color negative film is adjusted to the (2) medium aspect ratio of a print, the image quality of a print can be improved while reducing the enlargement magnification of a panorama print (a print of high aspect ratio), as compared with the conventional case. Accordingly, in the present invention, it is preferred to adjust the aspect ratio of an image part of a negative film to from 1.40 to 2.50, more preferably from 1.60 to 2.20, particularly preferably from 1.70 to 1.90.

The aspect ratio is preferably adjusted to a value approximated to an aspect ratio (1.78) of HDTV because a silver salt photographic film and an electronic imaging system can be smoothly hybridized. More specifically, the most preferred aspect ratio is from 1.75 to 1.85.

On the other hand, considering that a print having a high aspect ratio involves elevation of the enlargement magnification, in order to maintain the image quality, one picture area in the image part is preferably 3.0 $cm^2$ or more. However, if the area exceeds the image part area of a current 135 film, a patrone or a camera is disadvantageously increased in the size. Accordingly, the area of one picture in the image part is from 3.0 to 8.6 $cm^2$.

In order to secure the area of the above-described optical or magnetic information recording part, the upper bound of the image part area is preferably low and this is also preferred to achieve down-sizing of a patrone for housing a film. However, if the image part is reduced lower than the half size used at the present time, it is difficult to exert the effect of the present invention and to achieve the object of the present invention. Accordingly, the image part area is set to from 3.0 to 7.0 $cm^2$, more preferably from 4.0 to 6.0 $cm^2$.

Further, in order to secure the area of an optical or magnetic information recording part, the ratio ($S_2/S_1$) of the area ($S_2$) of an image part (a×b) to the area ($S_1$) of one picture as A×B in FIG. 2 is preferably 0.25 to 0.90. In view of the above-described image part area and the down-sizing of a patrone or a camera, the ratio $S_2/S_1$ is preferably from 0.50 to 0.90, more preferably from 0.60 to 0.8, particularly preferably from 0.65 to 0.75.

The light-sensitive material of the present invention using a polyester support, described in the foregoing, is preferably used as a color photographic light-sensitive material for photographing, more preferably, as a color negative photographic light-sensitive material for photographing.

As the image part area is designed to have a smaller format of from 3.0 to 7.0 $cm^2$, it becomes important to keep the planeness of film at the time of photographing. If the planeness is impaired, the focusing failure is caused and in particular, since the enlargement magnification in the printing from a small format negative film is large, the above-described poor planeness of film becomes a serious obstacle in displaying the sharpness as an advantage of the color negative light-sensitive material for photographing. Accordingly, it is particularly preferred to use a light-tight type cartridge having an attitude control mechanism and capable of preventing light fogging and a camera matching it disclosed, for example, in JP-A-3-089341.

Further, the photographing may be made while keeping the image part area of from 3.0 to 7.0 $cm^2$ and varying the aspect ratio in the range of from 1.40 to 2.50 and for example, a means and a mechanism described in JP-A-U-5-25446 (the term "JP-A-U" as used herein means an "unexamined published Japanese utility model application") may be introduced into a color light-sensitive material for photographing or into a camera.

The present invention is described below in greater detail with reference to Examples, however, the present invention should not be construed as being limited thereto as long as the scope of the present invention is observed.

EXAMPLE 1

1) Support

The support used in this example was prepared according to the following method.

100 Parts by weight of polyethylene-2,6-naphthalate polymer and 2 parts by weight of Tinuvin P.326 (produced by Ciba Geigy AG) as an ultraviolet absorbent were dried, melted at 300° C., extracted from a T-die, stretched in the machine direction at 140° C. to 3.3 times, then stretched in the transverse direction at 130° C. to 3.3 times and further heat set at 250° C. for 6 seconds to obtain a PEN (polyethylene naphthalate) film having a thickness of 90 μm. To the resulting PEN film, a blue dye, a magenta dye and a yellow dye (Compounds I-1, I-4, I-6, I-24, I-26, I-27 and II-5 described in *JIII Journal of Technical Disclosure*, No. 94-6023) were added in an appropriate amount. Further, the film was wound around a stainless steel core having a diameter of 20 cm to have heat history at 110° C. for 48 hours, thereby obtaining a support difficult of curling habit.

2) Coating of undercoat layer

Both surfaces of the support obtained above was subjected to corona discharge treatment, UV discharge treatment and glow discharge treatment, and an undercoating solution containing 0.1 $g/m^2$ of gelatin, 0.01 $g/m^2$ of sodium α-sulfodi-2-ethylhexylsuccinate, 0.04 $g/m^2$ of salicylic acid, 0.2 $g/m^2$ of p-chlorophenol, 0.012 $g/m^2$ of $(CH_2{=}CHSO_2CH_2CH_2NHCO)_2CH_2$ and 0.02 g/m of a polyamideepichlorohydrin polycondensate was coated (10 $ml/m^2$, using a bar coater) to provide an undercoat layer on the higher temperature side at the time of stretching. The drying was conducted at 115° C. for 6 minutes (rollers and the conveyance device in the drying zone all were heated to 115° C.).

3) Coating of back layer

On one surface of the undercoated support, an antistatic layer, a magnetic recording layer and a slipping layer each having the following composition were coated as a back layer.

3-1) Coating of antistatic layer

A fine particle powder dispersion having a resistivity of 5 Ω·cm of a tin oxide-antimony oxide composite having an average particle diameter of 0.005 μm (secondary aggregate particle size: about 0.08 μm) was coated in an amount of 0.2 $g/m^2$ together with 0.05 $g/m^2$ of gelatin, 0.02 $g/m^2$ of $(CH_2{=}CHSO_2CH_2CH_2NHCO)_2CH_2$, 0.005 $g/m^2$ of poly (polymerization degree: 10)oxyethylene-p-nonylphenol and 0.005 g $m^2$ of resorcin.

3-2) Coating of magnetic recording layer

Co-γ-iron oxide (0.06 $g/m^2$) (specific surface area: 43 $m^2/g$; longer axis: 0.14 μm; single axis: 0.03 μm; saturated magnetization: 89 emu/g; $Fe^{+2}/Fe^{+3}$=6/94; the surface being treated with aluminum oxide and silicon oxide each in an amount of 2 wt % based on iron oxide) subjected to covering treatment with 3-poly(polymerization degree: 15)oxyethylenepropyloxytrimethoxysilane (15 wt %) and dispersed in 1.2 $g/m^2$ of diacetyl cellulose (the iron oxide being dispersed by an open kneader and sand mill) and 0.3 $g/m^2$of $C_2H_5C(CH_2OCONHC_6H_3(CH_3)NCO)_3$ as a hardening agent was coated using acetone, methyl ethyl ketone and cyclohexanone as solvents by means of a bar coater to obtain a magnetic recording layer having a thickness of 1.2 μm. Silica particles (0.3 μm) as a matting agent and an alumina oxide (0.15 μm) subjected to covering treatment with 3-poly (polymerization degree: 15)oxyethylenepropyloxytrimethoxysilane (15 wt %) as an abrasive each was added to give a coverage of 10 $mg/m^2$. The drying was conducted at 115° C. for 6 minutes (rollers and the conveyance device in the drying zone all were heated to 115° C.). The increase in color density of the magnetic recording layer $D^B$ with X-light (blue filter) was about 0.1, the saturated magnetization moment of the magnetic recording layer was 4.2 $emu/m^2$, the coercive force was $7.3\times10^4$ A/m and the angular ratio was 65%.

3-3) Preparation of slipping layer

Diacetyl cellulose (25 $mg/m^2$) and a mixture of $C_6H_{13}CH(OH)C_{10}H_{20}COOC_{40}H_{81}$ (Compound a, 6 $mg/m^2$)/$C_{50}H_{101}O(CH_2CH_2O)_{16}H$ (Compound b, 9 $mg/m^2$) were coated. The mixture was prepared by melting the compounds in xylene/propylene monomethyl ether (1/1) at 105° C. and pouring/dispersing the melt in propylene monomethyl ether (10-fold amount) at normal temperature and the resulting mixture was formed into a dispersion (average particle size: 0.01 μm) in acetone and then added. Silica particles (0.3 μm) as a matting agent and an alumina oxide (0.15 μm) subjected to covering treatment with 3-poly (polymerization degree: 15)oxyethylenepropyloxytrimethoxysilane (15 wt %) as an abrasive each was added to give each coverage of 15 $mg/m^2$. The drying was conducted at 115° C. for 6 minutes (rollers and the conveyance device in the drying zone all were heated to 115° C.) The thus-obtained slipping layer had excellent capabilities such that the coefficient of dynamic friction was 0.06 (stainless steel ball: 5 mmφ; load: 100 g; speed: 6 cm/min), the coefficient of static friction was 0.07 (by clip method) and the coefficient of dynamic friction between the emulsion surface and the slipping layer, which will be described later, was 0.12.

4) Coating of light-sensitive layer

The layers each having the following composition was coated to overlay one on another on the side of a support opposite to the back layer provided above to prepare a color negative film. This film was designated as Sample 101.

(Composition of light-sensitive layer)

The main materials used in each layer are classified as follows.

ExC: cyan coupler
ExM: magenta coupler
ExY: yellow coupler
ExS: sensitizing dye
UV: ultraviolet absorbent
HBS: high-boiling point organic solvent
H: gelatin hardening agent (Specific compounds are described in the following with respective symbols followed by numerals and the chemical formulae thereof are set forth later.)

Numerals corresponding to respective components show coating amounts expressed by the unit $g/m^2$ and in case of silver halide, they show coating amounts in terms of silver. With respect to sensitizing dyes, the coating amount is shown by the unit mol per mol of silver halide in the same layer.

| | | |
|---|---|---|
| **First Layer (antihalation layer)** | | |
| Black colloidal silver | as silver | 0.09 |
| Gelatin | | 1.60 |
| ExM-1 | | 0.12 |
| ExF-1 | | $2.0 \times 10^{-3}$ |
| Solid Disperse Dye ExF-2 | | 0.030 |
| Solid Disperse Dye ExF-3 | | 0.040 |
| HBS-1 | | 0.15 |
| HBS-2 | | 0.02 |
| **Second Layer (interlayer)** | | |
| Silver Iodobromide Emulsion M | as silver | 0.065 |
| ExC-2 | | 0.04 |
| Polyethylacrylate latex | | 0.20 |
| Gelatin | | 1.04 |
| **Third Layer (low-sensitivity red-sensitive emulsion layer)** | | |
| Silver Iodobromide Emulsion A | as silver | 0.25 |
| Silver Iodobromide Emulsion B | as silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| **Fourth Layer (medium-sensitivity red-sensitive emulsion layer)** | | |
| Silver Iodobromide Emulsion C | as silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| **Fifth Layer (high-sensitivity red-sensitive emulsion layer)** | | |
| Silver Iodobromide Emulsion D | as silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| **Sixth Layer (interlayer)** | | |
| Cpd-1 | | 0.090 |
| Solid Disperse Dye ExF-4 | | 0.030 |
| HBS-1 | | 0.050 |
| Polyethylacrylate latex | | 0.15 |
| Gelatin | | 1.10 |

-continued

| | | |
|---|---|---|
| **Seventh Layer (low-sensitivity green-sensitive emulsion layer)** | | |
| Silver Iodobromide Emulsion E | as silver | 0.15 |
| Silver Iodobromide Emulsion F | as silver | 0.10 |
| Silver Iodobromide Emulsion G | as silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| **Eighth Layer (medium-sensitivity Green-sensitive emulsion layer)** | | |
| Silver Iodobromide Emulsion H | as silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| **Ninth Layer (high-sensitivity green-sensitive emulsion layer)** | | |
| Silver Iodobromide Emulsion I | as silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.33 |
| **Tenth Layer (yellow filter layer)** | | |
| Yellow colloidal silver | as silver | 0.015 |
| Cpd-1 | | 0.16 |
| Solid Disperse Dye ExF-5 | | 0.060 |
| Solid Disperse Dye ExF-6 | | 0.060 |
| Oil-Soluble Dye ExF-7 | | 0.010 |
| HBS-1 | | 0.60 |
| Gelatin | | 0.60 |
| **Eleventh Layer (low-sensitivity blue-sensitive emulsion layer)** | | |
| Silver Iodobromide Emulsion J | as silver | 0.09 |
| Silver Iodobromide Emulsion K | as silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| **Twelfth Layer (high-sensitivity blue-sensitive emulsion layer)** | | |
| Silver Iodobromide Emulsion L | as silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |

-continued

| | |
|---|---|
| HBS-1 | 0.070 |
| Gelatin | 0.70 |
| Thirteenth Layer (first protective layer) | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |
| Fourteenth Layer (second protective layer) | |
| Silver Iodobromide Emulsion M | as silver 0.10 |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

Further, in order to provide good preservability, processability, pressure durability, antimold/bactericidal property, antistatic property and coatability, W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, iron salt, lead salt, gold salt, platinum salt, palladium salt, iridium salt or rhodium salt was appropriately added to each layer.

Preparation of Dispersion Product of Organic Solid Disperse Dye

Solid Disperse Dye ExF-2 used in the above-described light-sensitive material was dispersed as follows. That is, 21.7 ml of water, 3 ml of a 5% aqueous solution of sodium p-octylphenoxyethoxyethoxyethanesulfonate and 0.5 g of a 5% aqueous solution of p-octylphenoxypolyoxyethylene ether (polymerization degree: 10) were poured into 700 ml-volume pot mill, then thereto 5.0 g of Dye ExF-2 and 500 ml of zirconium oxide beads (diameter: 1 mm) were added and the content was dispersed for 2 hours. In this dispersion, a BO-type vibration ball mill manufactured by Chuo Koki KK was used. After the dispersion, the content was taken out and added to 8 g of a 12.5% aqueous gelatin solution and the beads were removed by filtration to obtain a gelatin dispersion of the dye. The dye fine particles had an average particle size of 0.44 μm.

Solid dispersion products of ExF-3, ExF-4 and ExF-6 each was obtained in the same manner. The average particle size of dye fine particles was 0.24, 0.45 or 0.52 μm, respectively. ExF-5 was dispersed by the microprecipitation dispersion method described in Example 1 of EP-A-549489. The average particle size was 0.06 μm.

ExC-1

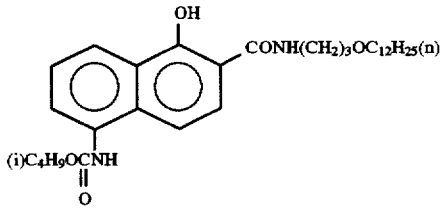

ExC-2

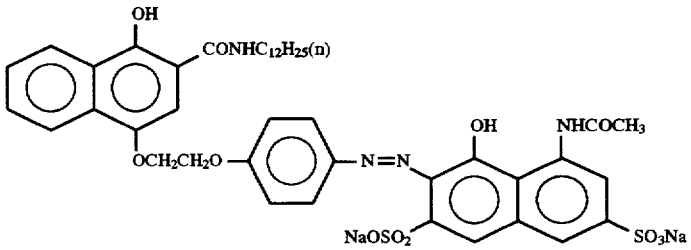

ExC-3

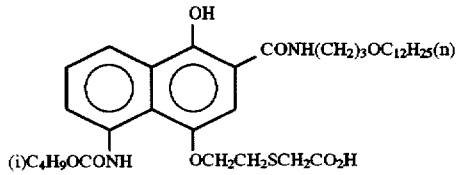

ExC-4

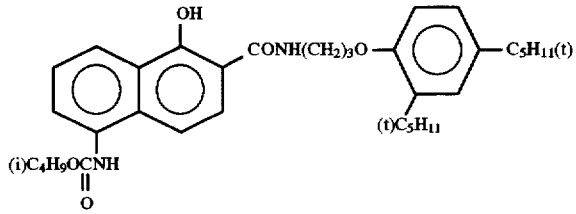

-continued
ExC-5
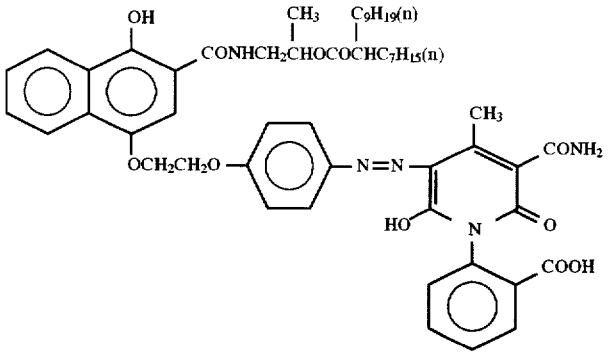
ExC-6
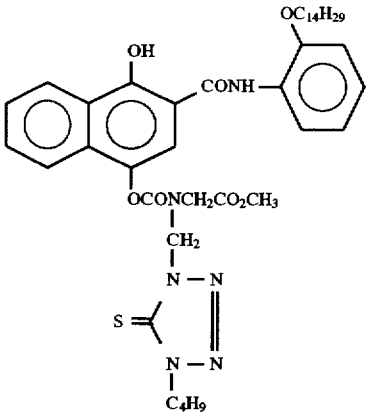
ExC-7
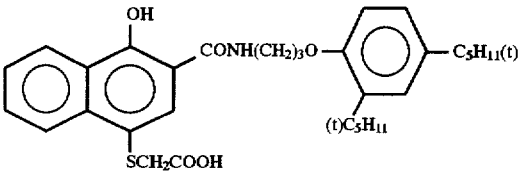
ExC-8
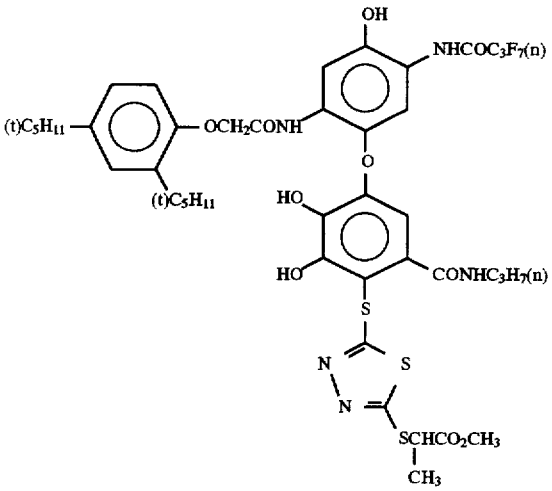

-continued
ExM-1
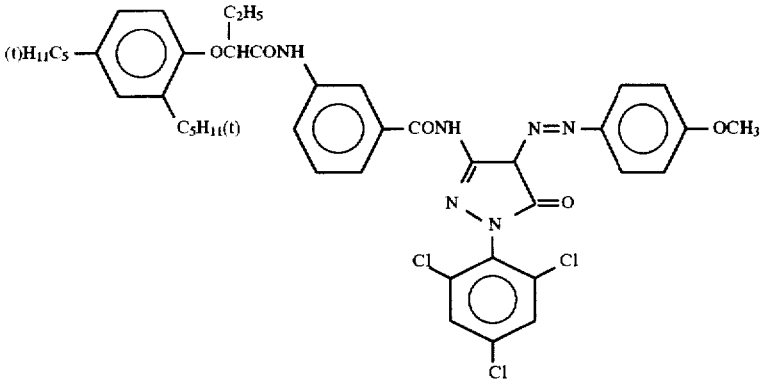
ExM-2
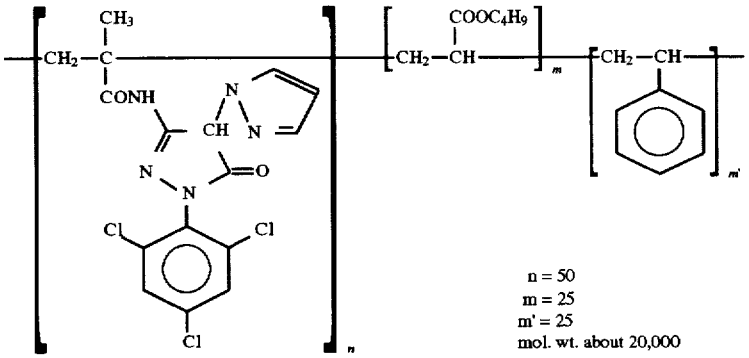
ExM-3
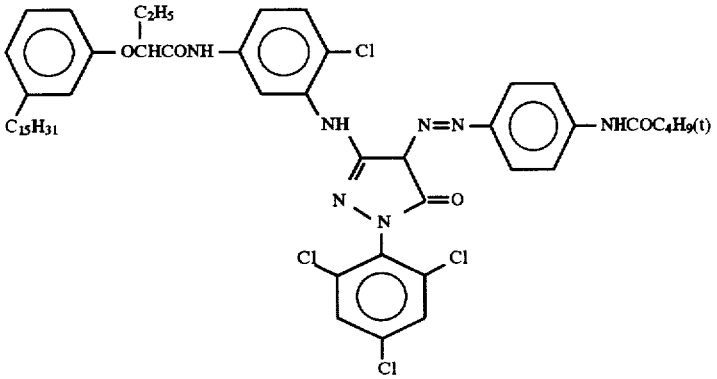
ExM-4
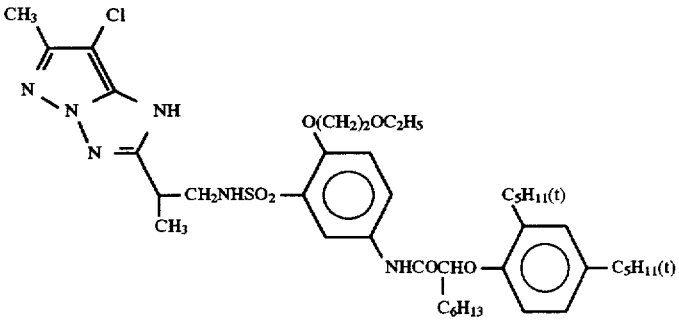

-continued
ExM-5
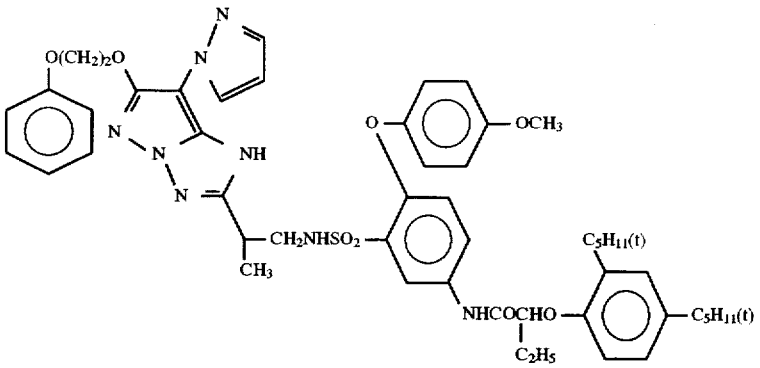
ExY-1
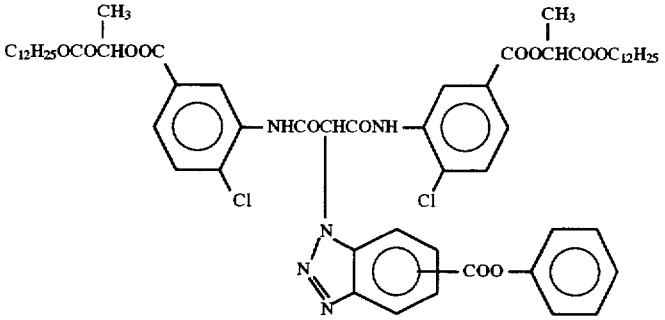
ExY-2
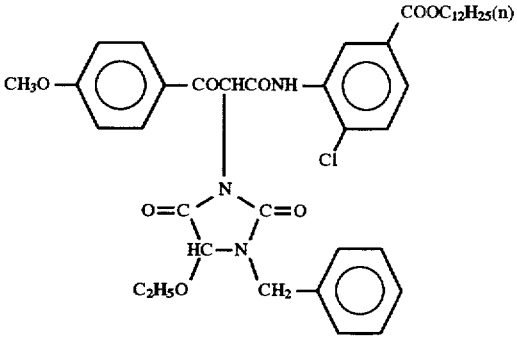
ExY-3
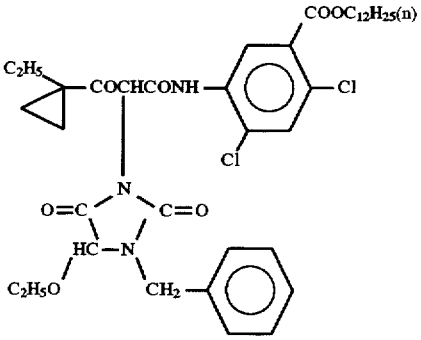

-continued
ExY-4
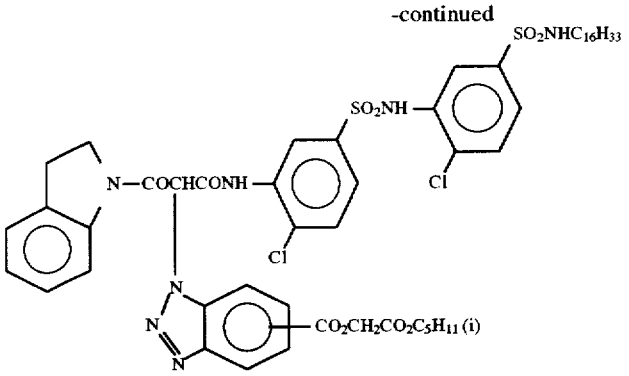
ExY-5
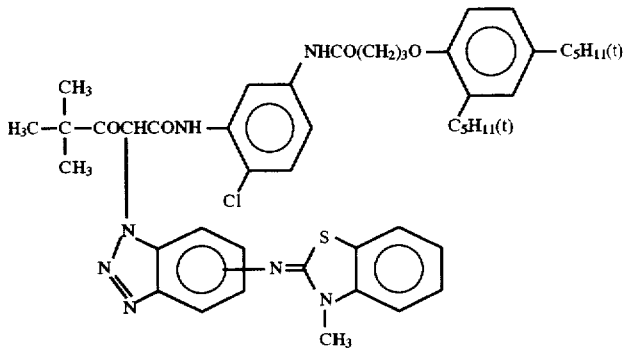
ExF-1
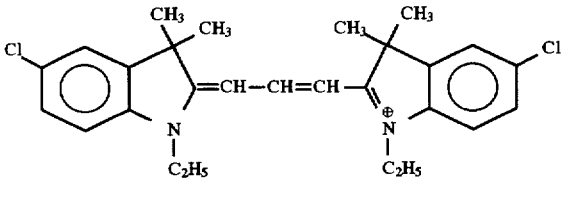
ExF-2
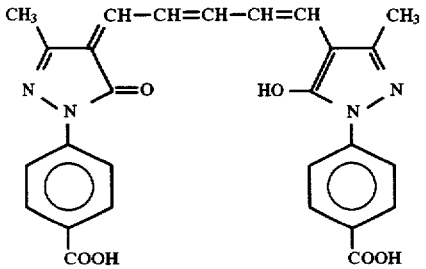
ExF-3
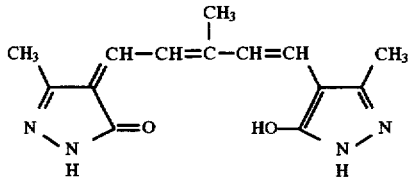
ExF-4
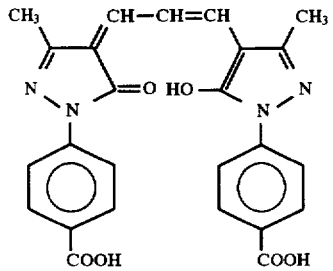

-continued
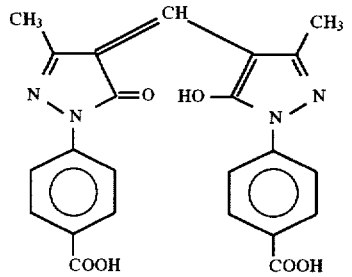
ExF-5
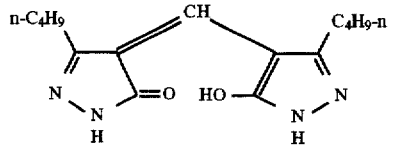
ExF-6
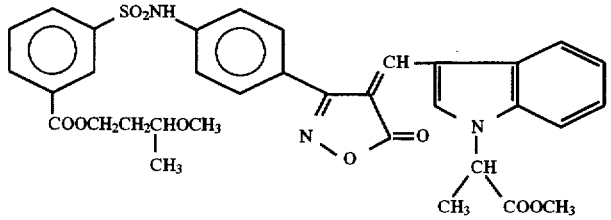
ExF-7
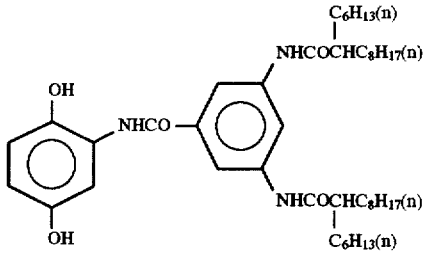
Cpd-1
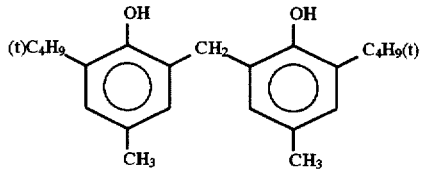
Cpd-2
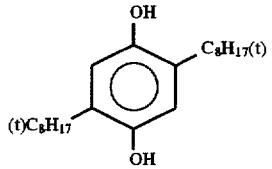
Cpd-3
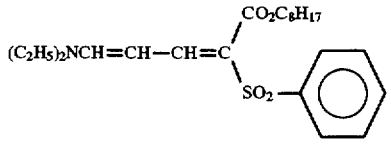
UV-1
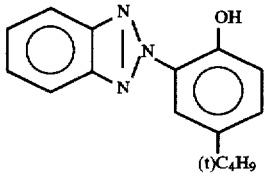
UV-2

-continued
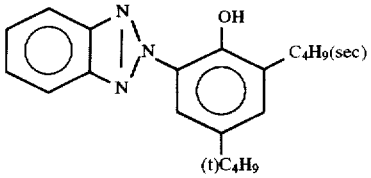
UV-3
tricresyl phosphate HBS-1
di-n-butyl phthalate HBS-2
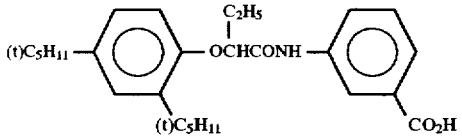
HBS-3
tri(2-ethylhexyl) phosphate HBS-4
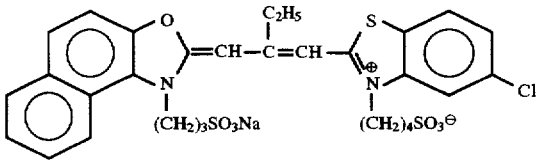
ExS-1
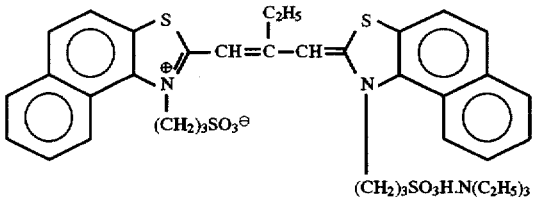
ExS-2
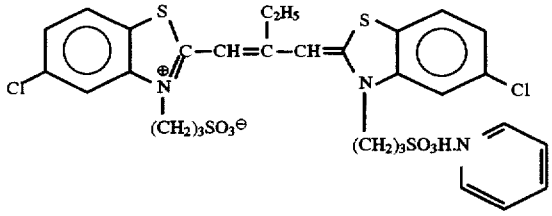
ExS-3
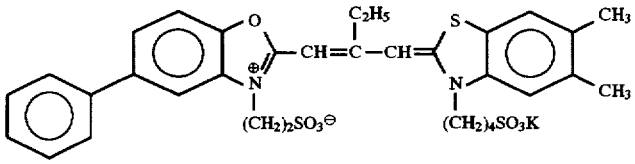
ExS-4
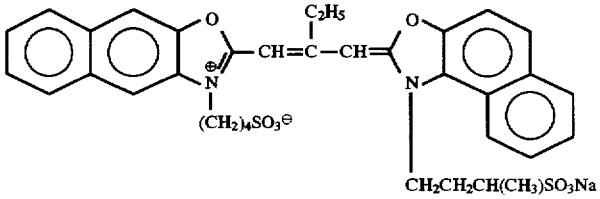
ExS-5
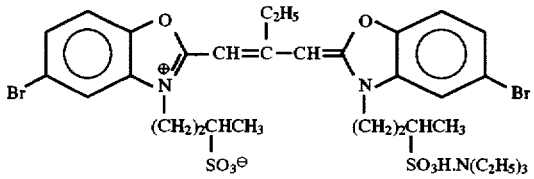
ExS-6

-continued
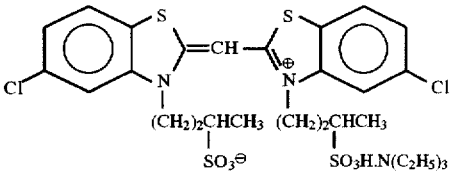
ExS-7
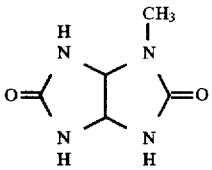
S-1
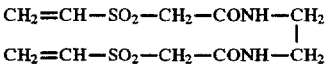
H-1
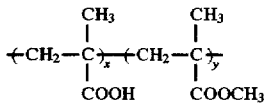
x/y = 10/90 (by weight)
Average Molecular Weight: about 35,000
B-1
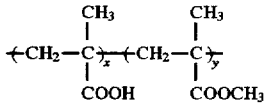
x/y = 40/60 (by weight)
Average Molecular Weight: about 20,000
B-2
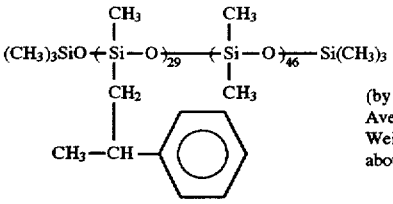
(by mol)
Average Molecular Weight: about 8,000
B-3
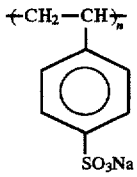
Average Molecular Weight: about 750,000
B-4
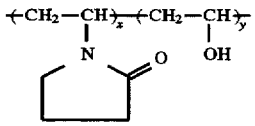
x/y = 70/30 (by weight)
Average Molecular Weight: about 17,000
B-5
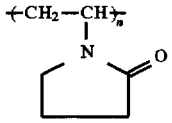
Average Molecular Weight: about 10,000
B-6
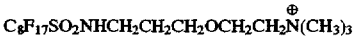
W-1
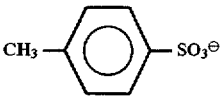
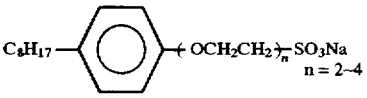
n = 2–4
W-2

-continued
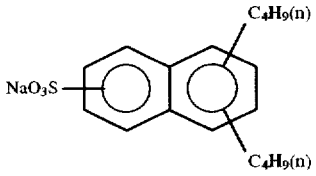
W-3
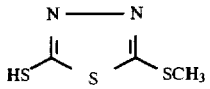
F-1
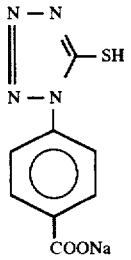
F-2
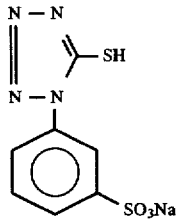
F-3
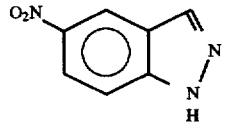
F-4
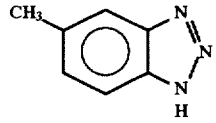
F-5
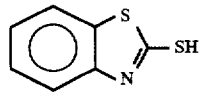
F-6
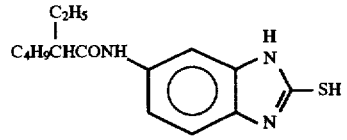
F-7
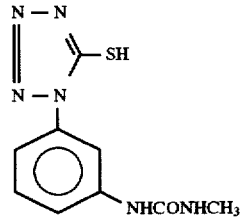
F-8
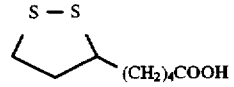
F-9

-continued

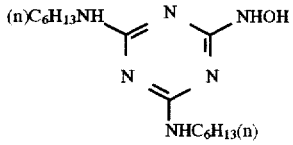

F-10

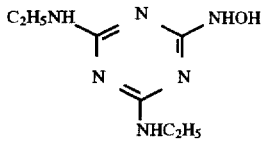

F-11

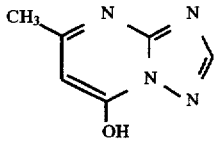

F-12

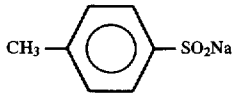

F-13

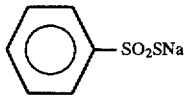

F-14

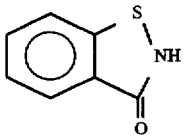

F-15

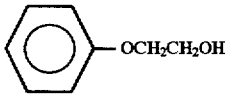

F-16

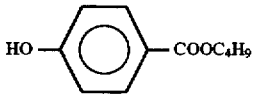

F-17

Samples 101-A to 101-G were prepared by variously setting and changing Silver Iodobromide Emulsions A to M of Sample 1 as shown in Table 1.

TABLE 1

| | | Sample No. | | | | | | | | | | | | | |
|---|---|---|---|---|---|---|---|---|---|---|---|---|---|---|---|
| | | 101-A Comparison | | 101-B Invention | | 101-C Invention | | 101-D Invention | | 101-E Invention | | 101-F Comparison | | 101-G Comparison | |
| | | Circle-corre-spond-ing dia-meter (μm) | Thick-ness (μm) | Circle-corre-spond-ing dia-meter (μm) | Thick-ness (μm) | Circle-corre-spond-ing dia-meter (μm) | Thick-ness (μm) | Circle-corre-spond-ing dia-meter (μm) | Thick-ness (μm) | Circle-corre-spond-ing dia-meter (μm) | Thick-ness (μm) | Circle-corre-spond-ing dia-meter (μm) | Thick-ness (μm) | Circle-corre-spond-ing dia-meter (μm) | Thick-ness (μm) |
| Emulsion | A | 0.28 | 0.07 | 0.28 | 0.07 | 0.31 | 0.17 | 0.31 | 0.17 | 0.31 | 0.17 | 0.28 | 0.07 | 0.31 | 0.17 |
| | B | 0.70 | 0.10 | 0.70 | 0.10 | 0.54 | 0.17 | 0.54 | 0.17 | 0.54 | 0.17 | 0.70 | 0.10 | 0.54 | 0.17 |
| | C | 1.02 | 0.17 | 1.02 | 0.17 | 1.02 | 0.17 | 1.02 | 0.17 | 1.02 | 0.17 | 1.02 | 0.17 | 1.02 | 0.17 |
| | D | 1.26 | 0.18 | 1.26 | 0.18 | 1.26 | 0.18 | 1.26 | 0.18 | 1.26 | 0.18 | 1.26 | 0.18 | 1.61 | 0.11 |
| | E | 0.28 | 0.07 | 0.18 | 0.17 | 0.28 | 0.07 | 0.18 | 0.17 | 0.18 | 0.17 | 0.18 | 0.17 | 0.28 | 0.07 |
| | F | 0.49 | 0.07 | 0.31 | 0.17 | 0.49 | 0.07 | 0.31 | 0.17 | 0.31 | 0.17 | 0.31 | 0.17 | 0.49 | 0.07 |
| | G | 0.70 | 0.10 | 0.54 | 0.17 | 0.70 | 0.10 | 0.54 | 0.17 | 0.54 | 0.17 | 0.54 | 0.17 | 0.70 | 0.10 |
| | H | 1.02 | 0.17 | 1.02 | 0.17 | 1.02 | 0.17 | 1.02 | 0.17 | 1.02 | 0.17 | 1.02 | 0.17 | 1.02 | 0.17 |
| | I | 1.26 | 0.18 | 1.26 | 0.18 | 1.26 | 0.18 | 1.26 | 0.18 | 1.26 | 0.18 | 0.98 | 0.30 | 1.26 | 0.18 |

TABLE 1-continued

| | Sample No. | | | | | | | | | | | | | |
|---|---|---|---|---|---|---|---|---|---|---|---|---|---|---|
| | 101-A Comparison | | 101-B Invention | | 101-C Invention | | 101-D Invention | | 101-E Invention | | 101-F Comparison | | 101-G Comparison | |
| | Circle-corresponding diameter (μm) | Thickness (μm) | Circle-corresponding diameter (μm) | Thickness (μm) | Circle-corresponding diameter (μm) | Thickness (μm) | Circle-corresponding diameter (μm) | Thickness (μm) | Circle-corresponding diameter (μm) | Thickness (μm) | Circle-corresponding diameter (μm) | Thickness (μm) | Circle-corresponding diameter (μm) | Thickness (μm) |
| J | 0.42 | 0.07 | 0.42 | 0.07 | 0.42 | 0.07 | 0.42 | 0.07 | 0.27 | 0.17 | 0.42 | 0.07 | 0.42 | 0.07 |
| K | 0.70 | 0.10 | 0.70 | 0.10 | 0.70 | 0.10 | 0.70 | 0.10 | 0.54 | 0.17 | 0.70 | 0.10 | 0.70 | 0.10 |
| L | 1.33 | 0.19 | 1.33 | 0.19 | 1.33 | 0.19 | 1.33 | 0.19 | 1.33 | 0.19 | 1.33 | 0.19 | 1.33 | 0.19 |
| M | 0.07 | 0.07 | 0.07 | 0.07 | 0.07 | 0.07 | 0.07 | 0.07 | 0.07 | 0.07 | 0.07 | 0.07 | 0.77 | 0.07 |

Emulsions A to M used in Samples 101-A to 101-G, respectively, had an average AgI content as shown in Table 2 below.

TABLE 2

| Emulsion | Average AgI Content (%) |
|---|---|
| A | 3.1 |
| B | 3.1 |
| C | 5.4 |
| D | 5.4 |
| E | 3.1 |
| F | 3.1 |
| G | 3.1 |
| H | 5.4 |
| I | 5.4 |
| J | 3.1 |
| K | 5.3 |
| L | 7.0 |
| M | 1.0 |

Emulsions J to L were subjected to reduction sensitization using thiourea dioxide and thiosulfonic acid at the time of grain preparation according to the example of JP-A-2-191938 (corresponding to U.S. Pat. No. 5,061,614).

Emulsions A to L were subjected to gold sensitization, sulfur sensitization and selenium sensitization in the presence of the spectral sensitizing dyes described in each light-sensitive layer and sodium thiocyanate according to the example of JP-A-3-237450 (corresponding to EP-A-443453). The tabular grains were prepared using low molecular weight gelatin according to the example of JP-A-1-158426 and dislocation lines were observed thereon through a high-pressure electron microscope as described in JP-A-3-237450 (corresponding to EP-A-443453).

The thus-prepared Light-Sensitive Material Nos. 101-A to 101-G were determined on the MTF value of photographs obtained therefrom according to T. H. James (compiler), *The Theory of the Photographic Process*, Chap. 21, pp. 592–635, Macmillan, N.Y. (1977). The exposure was conducted to white light and the development was conducted through the following steps using an automatic developing machine FP-360B manufactured by Fuji Photo Film Co., Ltd. The machine was modified so that the overflow solution of the bleaching bath did not flow into the post-bath but all was discharged to the waste water tank. On this FP-360B, an evaporation correcting means described in *JHI Journal of Technical Disclosure*, No. 94-4992 was mounted.

The processing steps and the composition of each processing solution are described below.

(Processing Step)

| Step | Processing Time | Processing Temperature (°C.) | Replenishing Amount* (ml) | Tank Volume (l) |
|---|---|---|---|---|
| Color development | 3 min 5 sec | 37.8 | 20 | 11.5 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Water washing | 30 sec | 38.0 | 17 | 3 |
| Stabilization (1) | 20 sec | 38.0 | — | 3 |
| Stabilization (2) | 20 sec | 38.0 | 15 | 3 |
| Drying | 1 min 30 sec | 60.0 | | |

*Replenishing amount was per 1.1 m of the light-sensitive material in width of 35 mm (corresponding to 1 roll of 24 Ex.).

The stabilizing solution and fixing solution each was in a countercurrent system of from (2) to (1) and the overflow solution of washing water was all introduced into the fixing bath (2). The carried-over amounts of developer into the bleaching step, of bleaching solution into the fixing step, of fixing solution into the water washing step were 2.5 ml, 2.0 ml and 2.0 ml, respectively, per 1.1 m of the light-sensitive material in width of 35 mm. The cross-over time was 6 seconds in each interval and this time is included in the processing time of the previous step.

The open area of the above-described processing machine was 100 $cm^2$ for the color developer, 120 $cm^2$ for the bleaching solution and about 100 $cm^2$ for other processing solutions.

The composition of each processing solution is shown below.

| (Color Developer) | Tank Solution (g) | Replenisher (g) |
|---|---|---|
| Diethylenetriaminepentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium N,N-bis(2-sulfonatoethyl)hydroxylamine | 1.5 | 2.0 |
| Potassium bromide | 1.3 | 0.3 |
| Potassium iodide | 1.3 mg | — |
| 4-Hydroxy-6-methyl-1,3,3a,7- | 0.05 | — |

-continued

| | | |
|---|---|---|
| tetrazaindene | | |
| Hydroxylamine sulfate | 2.4 | 3.3 |
| 2-Methyl-4-[N-ethyl-N-(β-hydroxyethyl)amino]aniline sulfate | 4.5 | 6.5 |
| Water to make | 1.0 l | 1.0 l |
| pH (adjusted by potassium hydroxide and sulfuric acid) | 10.05 | 10.18 |

| (Bleaching Solution) | Tank Solution (g) | Replenisher (g) |
|---|---|---|
| Ammonium 1,3-diamino-propanetetraacetato ferrate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 l | 1.0 l |
| pH (adjusted by aqueous ammonia) | 4.6 | 4.0 |

(Fixing (1) tank solution)

A mixed solution of the above-described bleaching tank solution and the following fixing tank solution -continued at a voluine ratio of 5:95.
(pH: 6.8)

| (Fixing (2) | Tank Solution (g) | Replenisher (g) |
|---|---|---|
| Aqueous solution of ammonium thiosulfate (750 g/l) | 240 ml | 720 ml |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water to make | 1.0 l | 1.0 l |
| pH (adjusted by aqueous ammonia and acetic acid) | 7.4 | 7.45 |

(Washing Water)

Tap water was passed through a mixed bed column filled with an H-type strongly acidic cation exchange resin (Amberlite IR-120B, produced by Rhom and Haas) and an OH-type strongly basic anion exchange resin (Amberlite IR-400, produced by the same company) to reduce the calcium and magnesium ion concentrations each to 3 mg/l or less and then thereto 20 mg/l of sodium isocyanurate dichloride and 150 mg/l of sodium sulfate were added. The resulting solution had a pH of from 6.5 to 7.5.

(Stabilizing Solution)
The tank solution and the replenisher were common.

| | (unit: g) |
|---|---|
| Sodium p-toluenesulfinate | 0.03 |
| Polyoxyethylene-p-monononylphenyl ether (average polymerization degree: 10) | 0.2 |
| Sodium 1,2-benzoisothiazolin-3-one | 0.10 |
| Disodium ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 l |
| pH | 8.5 |

The MTF values at spatial frequencies of 10 cycles/mm and 50 cycles/mm are shown as MTF values on the low frequency side and on the high frequency side, respectively, in Table 3. Any of these values is shown by taking the value of Sample No. 101-A as a standard value 100.

TABLE 3

| | | Sample No. | | | | | | |
|---|---|---|---|---|---|---|---|---|
| | | 101-A Comparison | 101-B Invention | 101-C Invention | 101-D Invention | 101-E Invention | 101-F Comparison | 101-G Comparison |
| Blue-sensitive layer | Low frequency | 100 | 100 | 100 | 100 | 102 | 100 | 100 |
| | High frequency | 100 | 100 | 100 | 100 | 100 | 100 | 100 |
| Green-sensitive layer | Low frequency | 100 | 103 | 100 | 103 | 103 | 103 | 100 |
| | High frequency | 100 | 105 | 100 | 105 | 103 | 98 | 100 |
| Red-sensitive layer | Low frequency | 100 | 100 | 103 | 104 | 104 | 98 | 96 |
| | High frequency | 100 | 105 | 106 | 110 | 108 | 95 | 94 |

Sample No. 101-B where silver halide grains in each layer of the green-sensitive layer as the three-layered unit light-sensitive layer of the present invention had an average grain thickness within the range of the present invention increased in the MTF value on the low frequency side of the green-sensitive layer and in the MTF value on the high frequency side of each of the green-sensitive layer and the red-sensitive layer, as compared with Sample No. 101-A for comparison. Sample No. 101-C where silver halide grains in each layer of the red-sensitive layer as the three-layered unit light-sensitive layer of the present invention had an average thickness within the range of the present invention increased in the MTF value on the low and high frequency sides of the red-sensitive layer, as compared with Sample 101-A for comparison. From this, it is seen that according to the present invention, the MTF values on the low frequency side and on the high frequency side can be increased without reducing the MTF value of other light-sensitive layers. Sample 101-D where silver halide grains in each layer of the green-sensitive layer as the three-layered unit light-sensitive layer and in each layer of the red-sensitive layer as the three-layered unit light-sensitive layer had an average thickness within the range of the present invention increased all in the MTF values on the low and high frequency sides of the green-sensitive layer and the red-sensitive layer, as compared with Sample 101-A for comparison, thus revealing outstanding effects of the present invention. Thus, it is preferred that silver halide grains in all layers constituting each unit light-sensitive layer having a three layer structure have an average grain thickness within the range of the present invention. As compared with this Sample 101-D, Sample No. 101-E where silver halide grains in each layer of the blue-sensitive layer as the two-layered unit light-sensitive layer had an average grain thickness within the range of the present invention increased in the MTF value on the low frequency side of the blue-sensitive layer but reduced in the MTF values on the high frequency side of the green-sensitive layer and the red-sensitive layer. This reveals that the average grain thickness in each layer of a three-layered, but not two-layered, unit light-sensitive layer is important and essential in the present invention. Sample 101-F where in the green-sensitive layer as the three-layered unit light-sensitive layer, the average thickness of silver halide grains in the maximum-sensitivity silver halide emulsion was made large beyond the range of the present invention reduced in the MTF values on the high frequency side of the green-sensitive layer and the red-sensitive layer and on the low frequency side of the red-sensitive layer, as compared with Sample 101-B of the present invention. That is, the grain thickness of less than 0.25 μm is an essential factor of the present invention. Sample No. 101-G where in the red-sensitive layer as a three-layered unit light-sensitive layer, silver halide grains of the maximum-sensitivity silver halide emulsion layer is reduced below the range of the present invention reduced in the MTF values on the high and low frequency sides of the red-sensitive layer. Thus, the grain thickness of 0.15 μm or more is an essential factor of the present invention. In other words, according to the present invention where silver halide grains in respective layers of a three-layered unit light-sensitive layer have an average grain thickness of from 0.15 to less than 0.25 μm, the MTF values on the high frequency side and on the low frequency side increase at the same time.

EXAMPLE 2

Samples Nos. 101-A to 101-G prepared in Example 1 each was processed to have one perforation on one side in the length direction of a 24 mm-width film per one picture and housed in a film housing cartridge described in JP-A-2-273740. A camera was modified so as to load the cartridge, the picture size in the exposure part was set to 30.0 mm×16.7 mm (exposed picture area: 5.01 $cm^2$, aspect ratio: 1.8) and a manikin (one body, the upper half) provided with a chart for evaluation of resolution was photographed under the following photographing conditions.

| Condition | Light Source | Contract of Object | Background | Others |
|---|---|---|---|---|
| A | day light (fine) | high | trees, mountains as a distant view | in the sun or in the shade |
| B | day light (cloudy) | low | trees, mountains as a distant view | |
| C | strobe | high | a light gray wall | |

Each film after the completion of photographing was processed using processing solutions having the compositions described in Example 1 according to the color development process described in Example 1. However, in this example, the processing was conducted using processing solutions after running processing of an imagewise exposed sample separately prepared at a rate of 1 $m^2$/day over 15 days.

The thus-processed color negative films each was printed on Fuji Color Paper Super FA Typell at a magnification of 7 times using an enlarger A650 Professional manufactured by Fuji Photo Film Co., Ltd. At this time, the color development processing used was CP-43FA.

The resulting prints each was cut into only an image part, placed on a gray plate (reflection density: 0.18) under a fluorescent lamp for color evaluation and evaluated on the sharpness by 10 monitors consisting of men and women.

The evaluation was conducted in such a way that a print from a film photographed using Multi-layer Color Light-sensitive Material No. 101-A was taken as a standard and two sheets of the standard print and other print were placed side by side and compared in sequence. Samples judged better than the standard were rated +1, samples equal to the standard or uncertain of judgement were rated 0, samples judged inferior to the standard were rated −1, and the arithmetical mean was calculated.

The results obtained are shown in Table 4.

TABLE 4

| Sample No. | Sharpness |
|---|---|
| 101-A (comparison) | 0.00 (standard) |
| 101-B (invention) | +0.30 |
| 101-C (invention) | +0.20 |
| 101-D (invention) | +0.50 |
| 101-E (invention) | +0.50 |
| 101-F (comparison) | −0.20 |
| 101-G (comparison) | −0.10 |

As is clearly seen from Table 4, according to the present invention, a color photographic light-sensitive material excellent in sharpness can be obtained.

According to the present invention, a silver halide color photographic light-sensitive material improved in sharpness, in particular, a light-sensitive material effective on use when the picture area of a film for photographing is reduced to increase the magnification on enlargement, thereby causing extreme deterioration in sharpness of a print can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one blue-sensitive silver halide emulsion layer, at least one green-sensitive silver halide emulsion layer and at least one red-sensitive silver halide emulsion layer, wherein at least one of said blue-sensitive silver halide emulsion layer, said green-sensitive silver halide emulsion layer and said red-sensitive silver halide emulsion layer comprises a low-sensitivity silver halide emulsion layer, a medium-sensitivity silver halide emulsion layer and a high-sensitivity silver halide emulsion layer having substantially the same spectral sensitivity but different in sensitivity, said low-sensitivity silver halide emulsion layer, said medium-sensitivity silver halide emulsion layer and said high-sensitivity silver halide emulsion layer are provided in this order from the side near to the support, the average grain thicknesses of all tabular silver halide grains in said low-sensitivity silver halide emulsion layer is from 0.15 to less than 0.25 μm, the average grain thickness of all tabular silver halide grains in said medium-sensitivity silver halide emulsion layer is from 0.15 to less than 0.25 μm and the average grain thickness of all tabular silver halide grains in said high-sensitivity silver halide emulsion layer is from 0.15 to less than 0.25 μm.

2. A silver halide color photographic light-sensitive material as claimed in claim 1, wherein said green-sensitive silver halide emulsion layer or said red-sensitive silver halide emulsion layer comprises said low-sensitivity, medium-sensitivity and high-sensitivity silver halide emulsion layers.

3. A silver halide color photographic light-sensitive material as claimed in claim 1, wherein said green-sensitive silver halide emulsion layer and said red-sensitive silver halide emulsion layer each comprises said low-sensitivity, medium-sensitivity and high-sensitivity silver halide emulsion layers.

4. A silver halide color photographic light-sensitive material as claimed in claim 2, wherein said low-sensitivity, medium-sensitivity and high-sensitivity silver halide emulsion layers are provided continuously to be in contact with each other.

5. A silver halide color photographic light-sensitive material as claimed in claim 1, wherein said support comprises a belt-like polyester base, from 1 to 4 perforations are formed per one picture on one or both side edge part of the support, the image part area is from 3.0 to 7.0 $cm^2$ and the aspect ratio thereof is from 1.40 to 2.50.

6. The photographic light-sensitive material of claim 1 wherein the low, medium and high and layers are differentiated by at least ½ stop.

7. The photographic light-sensitive material of claim 1 wherein the coefficient of variation of the grain thickness distribution is 20% or less.

8. The photographic light-sensitive material of claim 1 wherein the silver halide grains in the low-sensitivity silver halide emulsion have an average grain thickness of 0.15 to less than 0.20 μm and an average aspect ratio of from 1 to less than 4.

9. The photographic light-sensitive material of claim 1 wherein the silver halide grains in the medium-sensitivity silver halide emulsion layer have an average grain thickness of 0.15 to less than 0.20 μm and an average aspect ratio of from 3 to less than 10.

10. The photographic light-sensitive material of claim 1 wherein the silver halide grains in the high-sensitivity silver halide emulsion have an average grain thickness of 0.15 to less than 0.20 μm and an average aspect ratio of from 5 to less than 15.

11. The photographic light sensitive material of claim 1 wherein the tabular silver grains have at least 10 dislocation lines on average.

* * * * *